US008857597B2

(12) United States Patent
Sakamoto

(10) Patent No.: US 8,857,597 B2
(45) Date of Patent: Oct. 14, 2014

(54) BANKNOTE HANDLING APPARATUS

(71) Applicant: Glory Ltd., Himeji (JP)

(72) Inventor: Masao Sakamoto, Hyogo (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 0 days.

(21) Appl. No.: 13/948,479

(22) Filed: Jul. 23, 2013

(65) Prior Publication Data

US 2014/0027241 A1 Jan. 30, 2014

(30) Foreign Application Priority Data

Jul. 24, 2012 (JP) ..... 2012-163651
Jul. 31, 2012 (JP) ..... 2012-170098
Aug. 28, 2012 (JP) ..... 2012-187755

(51) Int. Cl.
*G07F 7/04* (2006.01)
*G07D 11/00* (2006.01)
*G07F 19/00* (2006.01)

(52) U.S. Cl.
CPC ..... *G07F 19/206* (2013.01); *G07D 11/0009* (2013.01); *G07D 11/0057* (2013.01); *G07D 11/0081* (2013.01)
USPC ..... 194/216; 194/217; 194/200; 194/206

(58) Field of Classification Search
CPC ..... G07F 7/04; G07F 19/205; G07F 19/206; G07F 19/209; G07D 2211/00
USPC ..... 194/200, 206, 207, 216, 217, 350; 235/379; 209/534
See application file for complete search history.

(56) References Cited

U.S. PATENT DOCUMENTS 6,315,279 B1 11/2001 Minamishin et al.
6,601,687 B1 * 8/2003 Jenrick et al. ..... 194/206
8,251,196 B2 * 8/2012 Dietz et al. ..... 194/206
2001/0054643 A1 12/2001 Siemens
2010/0230231 A1 9/2010 Uesaka et al.

FOREIGN PATENT DOCUMENTS

JP 2000-123219 A 4/2000
JP 2005-174221 A 6/2005
WO WO 2011/036782 A1 3/2011

OTHER PUBLICATIONS

European Search Report (Application No. 13177753.4) (6 pages—dated Nov. 11, 2013).

* cited by examiner

*Primary Examiner* — Mark Beauchaine
(74) *Attorney, Agent, or Firm* — Renner, Kenner, Greive, Bobak, Taylor & Weber

(57) ABSTRACT

A banknote handling apparatus recognizes and handles banknotes. The banknote handling apparatus includes a depositing unit, a dispensing unit, a plurality of banknote storing units, a transport unit, a recognition unit, and a control unit. The banknote handling apparatus further includes a portion for an optional attachment to which an escrow unit temporarily storing the banknotes in a process of the handling is selectively attachable. The control unit includes an option control unit performing control corresponding to an attached state of the escrow unit and control corresponding to an unattached state.

13 Claims, 19 Drawing Sheets

FIG.16

| ATTACHED/ DETACHED | | CONTROLLABLE PROCESSING | | | | |
|---|---|---|---|---|---|---|
| ESCROW UNIT | COLLECTION CASSETTE | DIRECT DEPOSITING | DEPOSITING | STORING/ RETURN | COLLECTING | DISPENSING |
| × | × | ○ | × | × | × | ○ |
| ○ | × | ○ | ○ | ○ | × | ○ |
| × | ○ | ○ | × | × | ○ | ○ |
| ○ | ○ | ○ | ○ | ○ | ○ | ○ |

FIG.20

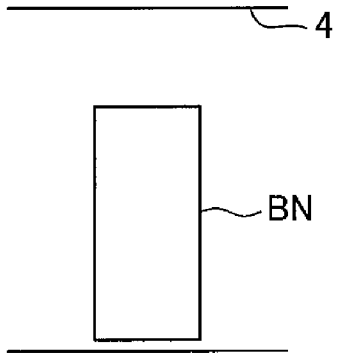

FIG.21

| FACTOR IN RECOGNITION | AT DEPOSITING | AT DISPENSING/ RECONCILIATION (FLAG: NORMAL) | AT DISPENSING/ RECONCILIATION (FLAG: ABNORMAL AND INCOMPLETE) |
|---|---|---|---|
| SKEW | REJECT | OK | REJECT |
| CHAIN | REJECT | OK | REJECT |
| SIZE ABNORMALITY | REJECT | OK | REJECT |
| OVERLAP (MULTIPLE BANKNOTE TRANSPORTATION) | REJECT | REJECT | REJECT |
| INELIGIBLE DENOMINATION | REJECT | REJECT | REJECT |
| ABNORMAL (INDEFINITE) DETERMINATION ON DENOMINATION | REJECT | OK (REPLACE DATA) | REJECT |
| ⋮ | ⋮ | ⋮ | ⋮ |

BANKNOTE HANDLING APPARATUS

CROSS-REFERENCE TO RELATED APPLICATION

This application claims priority to Japanese Patent Application No. 2012-163651 filed on Jul. 24, 2012, Japanese Patent Application No. 2012-170098 filed on Jul. 31, 2012, and Japanese Patent Application No. 2012-187755 filed on Aug. 28, 2012, the entire disclosure of which is incorporated by reference herein.

BACKGROUND

The present disclosure relates to banknote handling apparatuses recognizing banknotes and performing depositing/dispensing processing, etc.

A banknote handling system efficiently addressing addition of new notes when the new notes are circulated in addition to circulation of old notes are suggested (see, for example, Japanese Patent Publication No. 2005-174221). This banknote handling system includes a volatile DRAM area in addition to a non-volatile FLASH area storing firmware programs for basic control. When new notes are additionally circulated, a firmware program for checking the new notes is downloaded and temporarily stored in the DRAM area, thereby reducing steps of developing firmware.

In the field of printers and copiers, firmware is generally automatically updated in accordance with the type of an optional device to be added.

SUMMARY

In general, banknote handling apparatuses mount firmware corresponding to the configuration of hardware on a type-by-type basis. Thus, even when an optional unit is attached and the configuration of hardware partially changes, firmware with an updated control program has been newly fabricated and the entire firmware has been replaced with another one.

However, in a minor configuration change of simply attaching an optional unit etc., the former firmware and the replacement firmware have lots of common processing functions, and thus it is inefficient to replace the firmware every time.

The present disclosure provides a technique of efficiently addressing attachment of an optional unit to a banknote handling apparatus.

Specifically, a banknote handling apparatus according to a principal aspect of the present disclosure recognizes and handles banknotes. The apparatus includes a depositing unit configured to deposit the banknotes; a dispensing unit configured to dispense the banknotes; a plurality of banknote storing units configured to store the banknotes; a transport unit configured to transport the banknotes; a recognition unit provided at the transport unit, and configured to recognize the banknotes; a control unit configured to control the handling of the banknotes; and a portion for an optional attachment to which an escrow unit temporarily storing the banknotes in a process of the handling is selectively attachable. The control unit includes an option control unit performing control corresponding to an attached state of the escrow unit, and control corresponding to an unattached state.

BRIEF DESCRIPTION OF THE DRAWINGS

FIG. 16 illustrates controllable processing according to the attached and unattached states of an optional unit.

FIG. 20 illustrates an example one-sided banknote.

FIG. 21 illustrates example settings of factors in recognition, factors in determination, and non-factors.

DETAILED DESCRIPTION

A banknote handling apparatus according to a principal aspect of the present disclosure recognizes and handles banknotes. The banknote handling apparatus includes a depositing unit configured to deposit the banknotes; a dispensing unit configured to dispense the banknotes; a plurality of banknote storing units configured to store the banknotes; a transport unit configured to transport the banknotes; a recognition unit provided at the transport unit, and configured to recognize the banknotes; a control unit configured to control the handling of the banknotes; a portion for an optional attachment to which an escrow unit temporarily storing the banknotes in a process of the handling is selectively attachable. The control unit includes an option control unit performing control corresponding to an attached state of the escrow unit, and control corresponding to an unattached state.

A banknote handling apparatus according to another aspect of the present disclosure includes a chamber for an optional attachment to which a cassette attachable to and detachable from the banknote handling apparatus with the banknotes stored, or an additional storing unit provided in addition to the banknote storing units is selectively attachable. The control unit includes an option control unit performing control corresponding to an attached state of the cassette or the additional storing unit, and control corresponding to an unattached state.

Each of the banknote handling apparatuses includes the portion for an optional attachment to which the escrow unit is selectively attachable, or the chamber for an optional attachment to which the cassette or the additional storing unit is selectively attachable. The control unit includes the option control unit performing the control corresponding to the attached and unattached states of the escrow unit, the cassette, or the additional storing unit.

Therefore, there is no need to replace firmware with another one even in attaching or detaching the escrow unit, etc., which performs processing such as depositing/dispensing in functional corporation with the other units, thereby improving the efficiency.

An embodiment of the present disclosure will be described hereinafter with reference to the drawings. The following description is intended to be illustrative only and should not be taken as limiting the scope and application of our invention.

A banknote handling apparatus 1 according to this embodiment is generally used in the field handling a large amount of cash. The banknote handling apparatus 1 is, for example, a depositing/dispensing machine placed at a teller counter of a bank, and performs troublesome processing such as depositing, dispensing, counting, storing, and managing of cash. The banknote handling apparatus 1 increases the accuracy and efficiency of the work.

Example Application of Banknote Handling Apparatus 1

Figure 1:
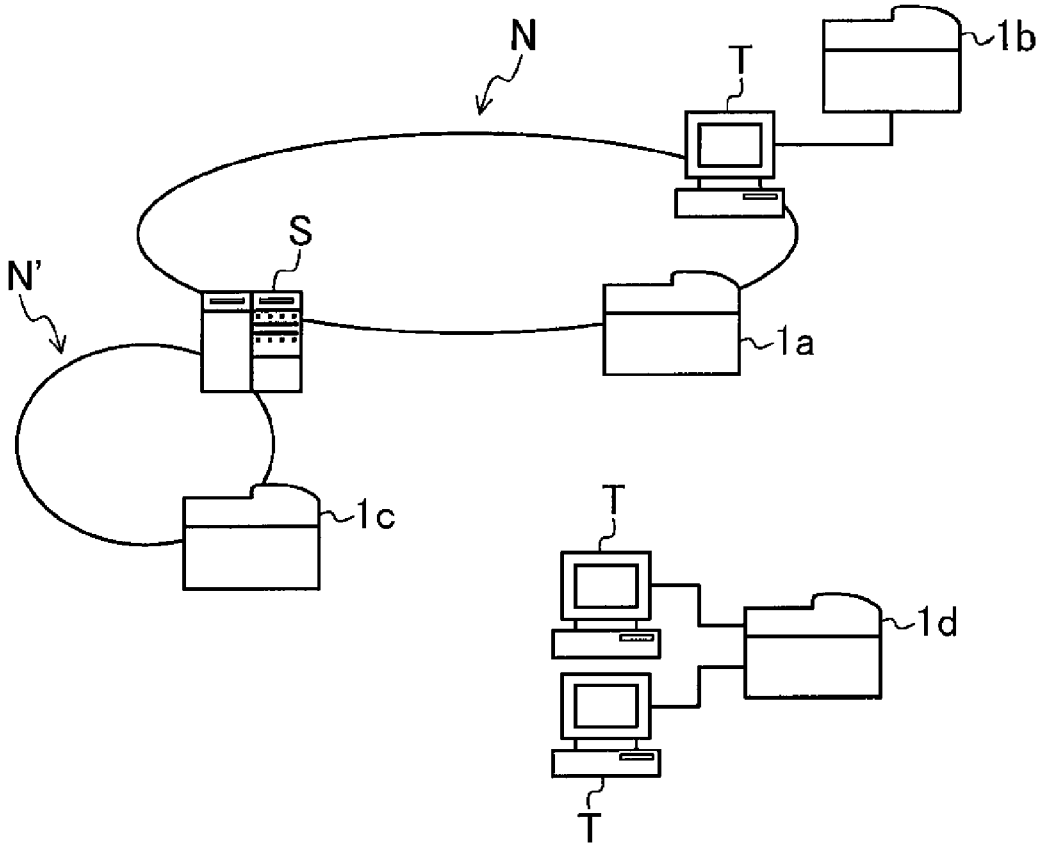
FIG. 1 is a schematic view illustrating an example system using a banknote handling apparatus.

FIG. 1 illustrates an example system using the banknote handling apparatus 1. The banknote handling apparatus 1 is connected communicatively to a higher-ranking terminal and a server via network such as LAN and WAN, and systemized for use. For example, in the figure, as a banknote handling apparatus 1*a*, the banknote handling apparatus 1 may be used in connection with a network N including a higher-ranking terminal T and other devices. As a banknote handling apparatus 1*b*, the banknote handling apparatus 1 may be used in connection with the higher-ranking terminal T on the network N. As a banknote handling apparatus 1*c*, the banknote handling apparatus 1 may be used in connection with another network N' via a server S.

Alternatively, as a banknote handling apparatus 1*d*, the banknote handling apparatus 1 may be used in direct connection with an independent higher-ranking terminal T. In this case, the number of the higher-ranking terminal T is not limited to one. As shown in the figure, the banknote handling apparatus 1 may be connected to a plurality of higher-ranking terminals T and one of the higher-ranking terminals T may be selected by switching for use.

The description names banknotes depending on their conditions to distinguish one from another. Specifically, "normal banknotes" denote banknotes which can be recognized by a recognition unit. "Banknotes to be rejected" denote banknotes which cannot be recognized by the recognition unit. In other words, the normal banknotes are acceptable to the banknote handling apparatus 1. The banknotes to be rejected are unacceptable to the banknote handling apparatus 1. "Fit notes" are, out of the normal banknotes, relatively little stained or torn.

Structure of Banknote Handling Apparatus 1

Figure 2:
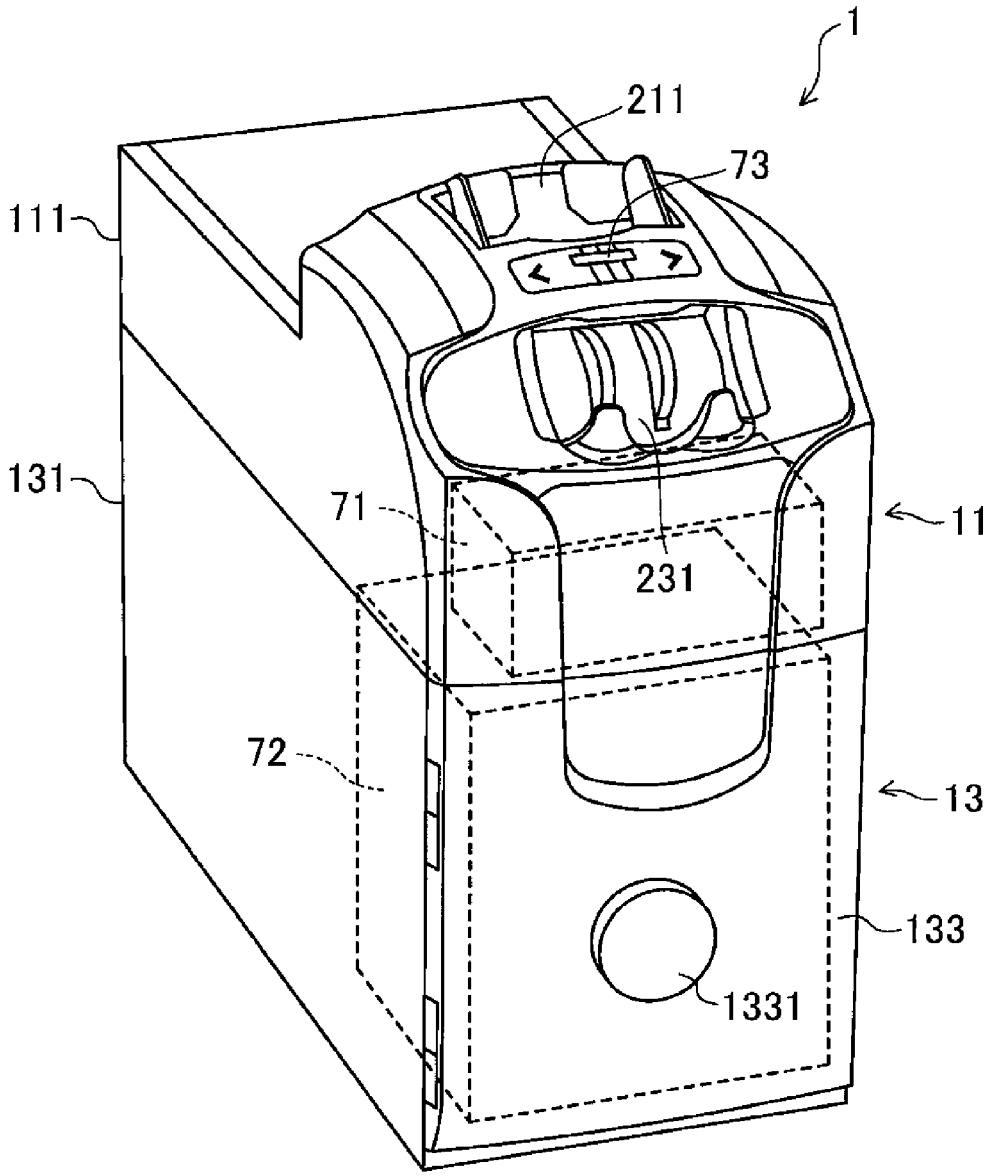
FIG. 2 is a schematic perspective view illustrating the appearance of the banknote handling apparatus.
Figure 3:
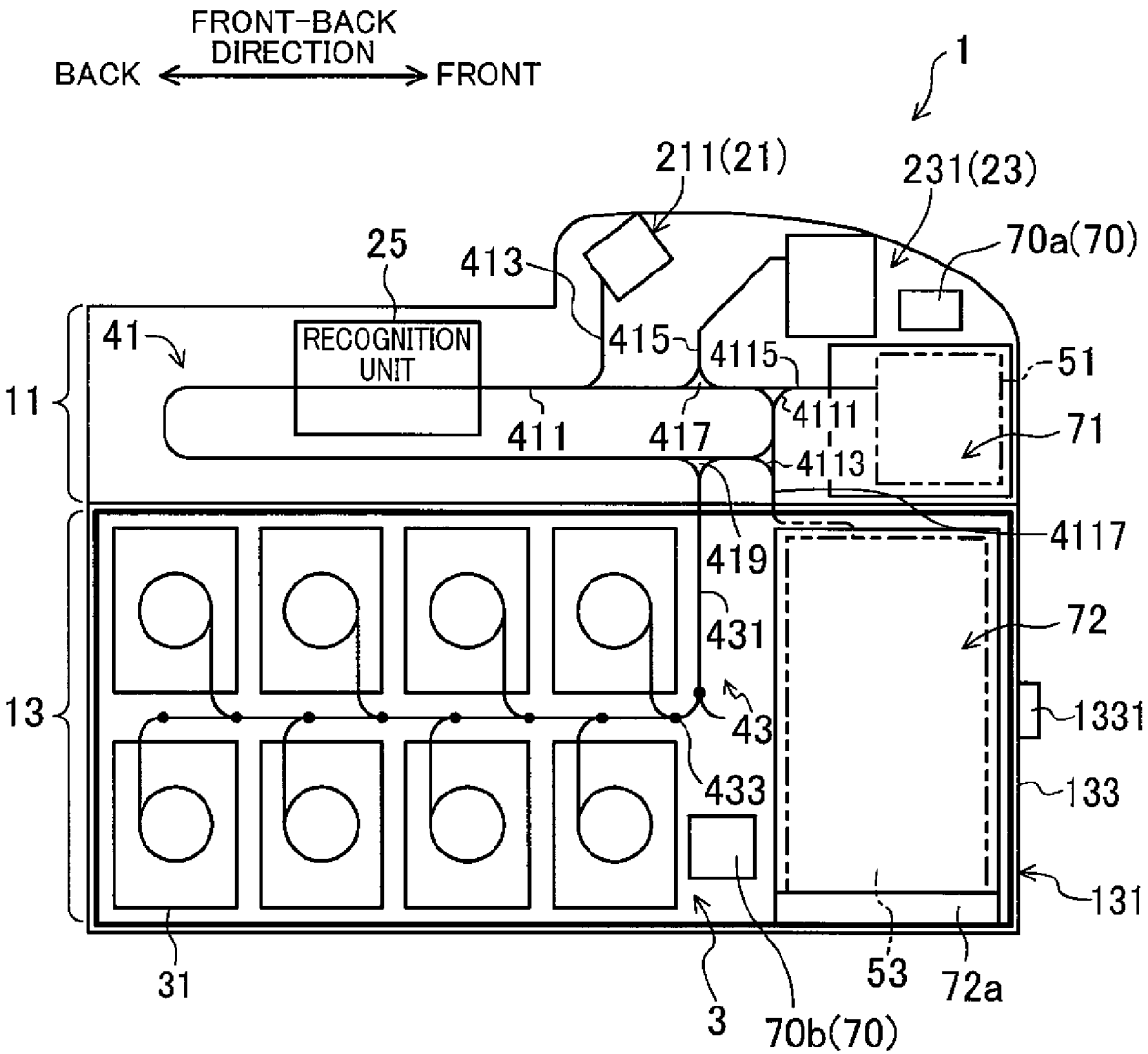
FIG. 3 is a schematic cross-sectional view illustrating the internal configuration of the banknote handling apparatus.

FIGS. 2 and 3 illustrate the banknote handling apparatus 1. This banknote handling apparatus 1 is what is called a "circulation banknote handling apparatus." That is, the banknotes dispensed in dispensing processing include those stored in depositing processing.

The banknote handling apparatus 1 is largely divided into a processor 11 located in a higher position, and a safe 13 located in a lower position. A case 111 forming the processor 11 includes a depositing unit 21 with an inlet 211, a dispensing unit 23 with an outlet 231, a recognition unit 25, and a transport unit 41 including a loop transport path 411.

A protective case 131 forming the safe 13 includes a banknote storing unit 3 including a plurality of (eight in the figure) winding storing modules 31, and a safe-side transport unit 43 including a transport path 431 connecting the loop transport path 411 to the storing modules 31. At the front of the protective case 131, a door 133 for opening and closing the safe 13, and an electronic key 1331.

The recognition unit 25 recognizes the authentication, denomination, and fitness of the banknotes. Also, the recognition unit 25 counts the number of banknotes. (Recognition and counting are hereinafter comprehensively referred to as recognition.)

The transport unit 41 (also referred to as a "processor-side transport unit 41" to be distinguished from the safe-side transport unit 43) includes the loop transport path 411 in the processor-side case 111. The loop transport path 411 allows long edge feed of banknotes one by one. The loop transport path 411 is connected to the inlet 211 by a depositing path 413. The loop transport path 411 is also connected to a dispensing path 415 selectively transporting banknotes, which is sent through the loop transport path 411, to the outlet 231 by operation of a diverter 417.

The loop transport path 411 is provided with plurality of other diverters. Specifically, a first diverter 419 is provided at the connecting position between the loop transport path 411 and the transport path 431 of the safe-side transport unit 43. The first diverter 419 selectively sends to the transport path 431 of the safe-side transport unit 43, the banknotes transported through the loop transport path 411 clockwise or counterclockwise, or switches between clockwise transport and counterclockwise transport of the banknotes, which are fed out of the banknote storing unit 3 and transported along the transport path 431, through the loop transport path 411.

A second diverter 4111 is provided at the connecting position between the loop transport path 411 and a connecting path 4115. The second diverter 4111 sends, to the connecting path 4115, the banknotes transported through the loop transport path 411 clockwise or counterclockwise, or switches between clockwise transport and counterclockwise transport of the banknotes, which are fed out of the escrow unit 51, through the loop transport path 411.

A third diverter 4113 is provided at the connecting position between the loop transport path 411 and a cassette-connecting path 4117. The third diverter 4113 selectively sends to the cassette-connecting path 4117, the banknotes transported through the loop transport path 411 clockwise or counterclockwise.

As described above, the banknote storing unit 3 includes, in the figure, first to eighth winding (i.e., tape-type) storing modules 31. The number of the storing modules 31 is not particularly limited, and may be any preferred number of one or more. In this example, every four of the eight storing modules 31 form a line in the depth direction of the apparatus. That is, the two lines are stacked one above the other in the vertical direction. In the description, the reference character 31 is used to collectively refer to the storing modules, and the reference characters $31_{-1}$, $31_{-2}$, $31_{-3}$, . . . are used to distinguish the first, second, third, . . . storing modules from another (see FIG. 15).

For example, one storable denomination may be allocated to each of the storing modules 31 so that the storing modules 31 may be used on a denomination-by-denomination basis (i.e., single denomination allocation). Alternatively, a plurality of denominations may be allocated to each of the storing modules 31 so that the plurality of denominations are stored in mixture in the corresponding one of the storing modules 31 (i.e., mixed denomination allocation). As such, the banknote storing unit 3 may be formed by the storing modules 31 based on the single-denomination allocation only, or the storing modules 31 based on the mixed denomination allocation in combination with the storing modules 31 based on the single-denomination allocation. Unless otherwise stated, the banknote handling apparatus 1 performs the single-denomination allocation.

As shown in Japanese Patent Publication No. 2000-123219, each winding storing module 31 may include, in a substantial rectangular box case, a tape guiding banknotes, a guide member, and a reel winding up the tape together with the banknotes. Alternatively, as shown in International Patent Publication No. WO 2011/36782, which has been filed by the Applicant, each winding storing module 31 may include in a case, two tapes sandwiching banknotes, and a reel winding up the two tape with the banknotes sandwiched therebetween.

In each of the configurations, each winding storing module 31 winds up and stores the banknotes one by one, and feeds out the banknotes one by one in the order opposite to the storing order, i.e., on a first-in-last-out basis. Each of the storing modules 31 winds up the banknotes in the reel at predetermined intervals. Each storing module 31 also includes a detection sensor (not shown) for detecting the pass of the banknotes near an opening allowing the case to communicate with the outside.

Similar to the loop transport path 411 of the processor-side transport unit 41, the transport path 431 of the safe-side transport unit 43 is formed by a combination of a roller, a belt, and a guide. The transport path 431 performs long edge feed of the banknotes one by one. The transport path 431 vertically extends below from the first diverter 419 in the loop transport path 411, and diverse to the front and back in the front-back direction at a lower portion. The diverting path extending to the back is located between the two stacked lines of the storing modules 31. Each of the storing modules 31 is connected to the diverting path via an allocator 433 provided in the diverting path. The drive of the allocator 433 is controlled by a control unit 513. As a result, the banknotes are allocated to, and stored in the plurality of storing modules 31 in accordance with the denomination, fitness, etc., recognized by the recognition unit 25.

As shown in FIG. 3, this banknote handling apparatus 1 includes a plurality of firmware modules 70 which are non-volatile memories forming the control unit 513. Specifically, the processor 11 includes a first firmware 70*a*, and the safe 13 includes a second firmware 70*b*. The first firmware 70*a* mounts a control program mainly controlling various types of banknote processing. The second firmware 70*b* mounts a control program mainly controlling the drive of the storing modules 31.

The number of the firmware module(s) 70 may one, three, or more. The location of the firmware modules 70 may be selected as appropriate in accordance with the specifications. In the description, the first firmware 70*a* and the second firmware 70*b* are collectively handled as firmware 70.

An optional unit may be selectively attached to the banknote handling apparatus 1 to form different hardware.

Specifically, a space to which an optional unit is selectively attachable (i.e., a portion 71 for an optional attachment) is provided at the front in the processor-side case 111. A space to which an optional unit is selectively attachable (i.e., a chamber 72 for an optional attachment) is provided at the front in the protective case 131, i.e., at the right back of the door 133.

As the optional unit, an escrow unit 51 temporarily storing the banknotes in the middle of processing is selectively attached to the portion 71 for an optional attachment. As the optional unit, a collection cassette 53 attachable to and detachable from the protective case 131 with the banknotes stored is selectively attached to the chamber 72 for an optional attachment. Alternatively, an additional storing unit 54 provided in addition to the banknote storing units 3 is selectively attached to the chamber 72 for an optional attachment.

Figure 4A:
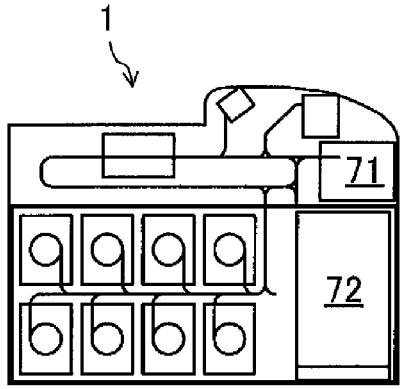
FIGS. 4A-4F are schematic views illustrating hardware configuration patterns of the banknote handling apparatus.
Figure 4B:
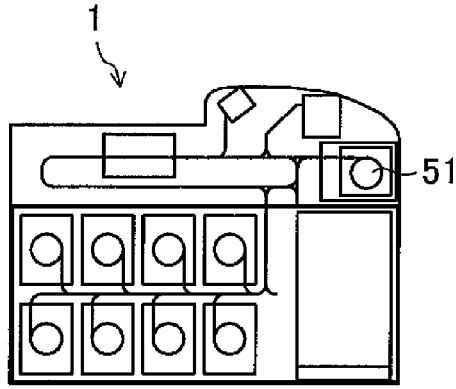
Figure 4C:
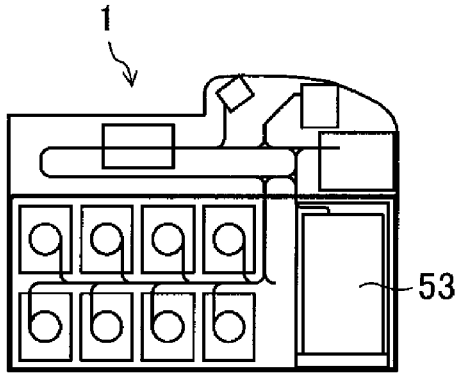
Figure 4D:
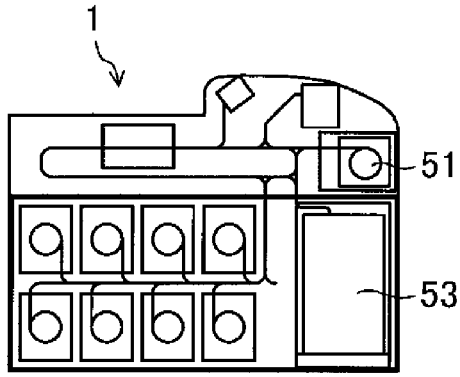
Figure 4E:
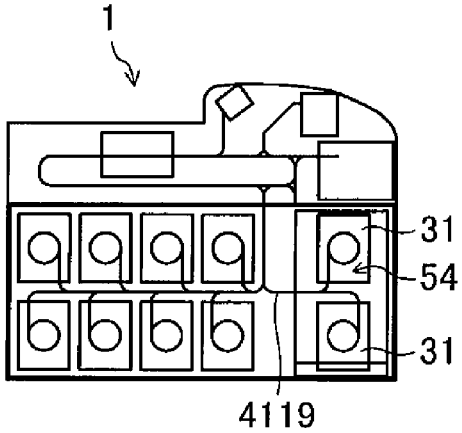
Figure 4F:
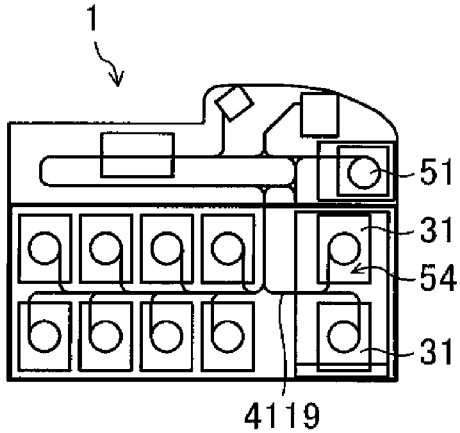

As shown in FIGS. 4A-4F, the banknote handling apparatus 1 may selectively have the following six patterns of hardware configurations. In FIG. 4A, none of the optional units 51, 53, and 54 are attached. In FIG. 4B, only the escrow unit 51 is attached. In FIG. 4C, only the collection cassette 53 is attached. In FIG. 4D, both of the escrow unit 51 and the collection cassette 53 are attached. In FIG. 4E, only the additional storing unit 54 is attached. In FIG. 4F, both of the escrow unit 51 and the additional storing unit 54 are attached.

Figure 5:
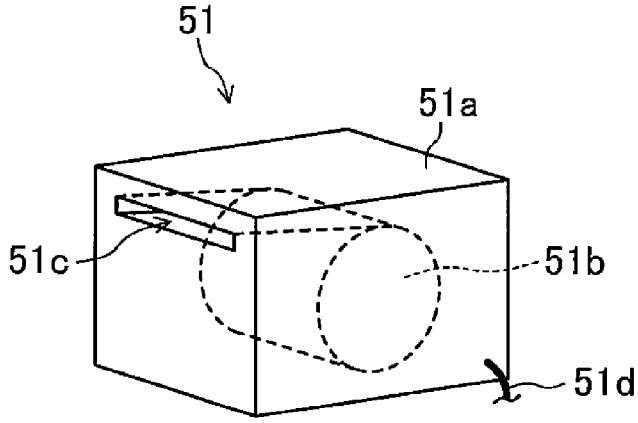
FIG. 5 is a schematic perspective view illustrating the appearance of an escrow unit.

As shown in FIG. 5, the escrow unit 51 is the optional unit having a configuration similar to those of the storing modules 31. Specifically, the escrow unit 51 roughly includes a rectangular box case 51*a*, a reel 51*b* provided in the case 51*a* and winding up the banknotes. The escrow unit 51 stores the banknotes on a first-in-last-out basis without changing the order of the banknotes.

The case 51*a* has an opening 51*c*, which is connected to the connecting path 4115. The banknotes are in and out of the escrow unit 51 through the opening 51*c*. The escrow unit 51, which is attached to the portion 71 for an optional attachment, is connected to the second diverter 4111 via the connecting path 4115. An electrical wiring group 51*d* supplying a drive current and a control current to the escrow unit 51 is led out of the case 51*a*. This electrical wiring group 51*d* is electrically connected to a predetermined electrical wiring group at the processor 11 side.

Figure 6:
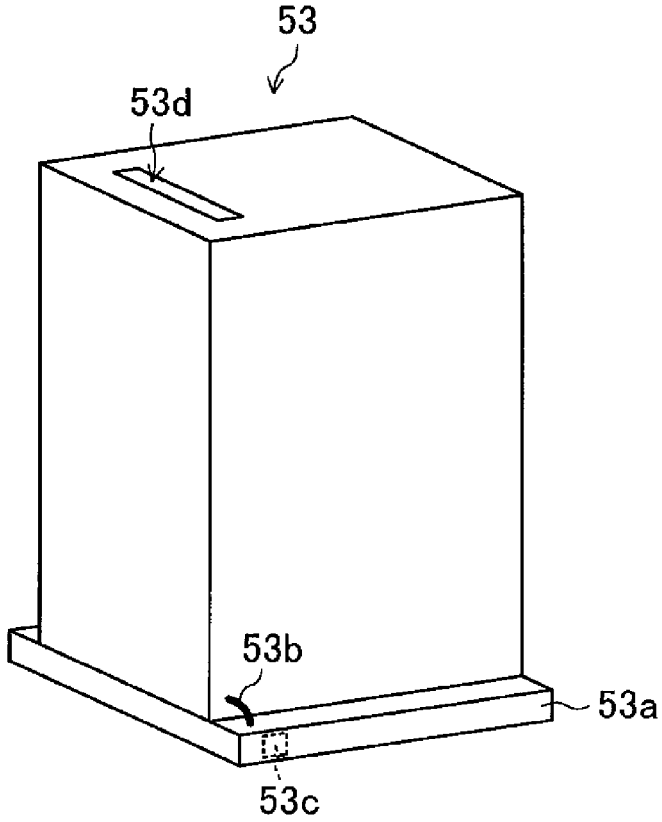
FIG. 6 is a schematic perspective view illustrating the appearance of a collection cassette.

As shown in FIG. 6, the collection cassette 53 is the optional unit formed in a vertically long box. Different from the winding storing modules 31 and the escrow unit 51, the collection cassette 53 includes inside, a stacking table lifting and lowering. Although not shown, banknotes are stacked and stored on the stacking table. That is, the banknotes stored in the collection cassette 53 cannot be fed out.

A first frame 53*a* is attached at a lower portion of the collection cassette 53. An electrical wiring group 53*b*, which is led out of a lower portion of the collection cassette 53, is electrically connected to a relay terminal 53*c* of the first frame 53*a*. An opening 53*d* through which the banknotes are in and out is formed at an upper portion of the collection cassette 53.

As shown in FIG. 3, a frame fixing unit 72*a* is provided at a lower portion of the chamber 72 for an optional attachment. The collection cassette 53 is attachable to and detachable from the frame fixing unit 72*a* via the first frame 53*a*.

The collection cassette 53 attached to the chamber 72 for an optional attachment is connected to the third diverter 4113 through the cassette connecting path 4117. The relay terminal 53*c* is electrically connected to a predetermined electrical wiring group at the safe 13 side.

Figure 7:
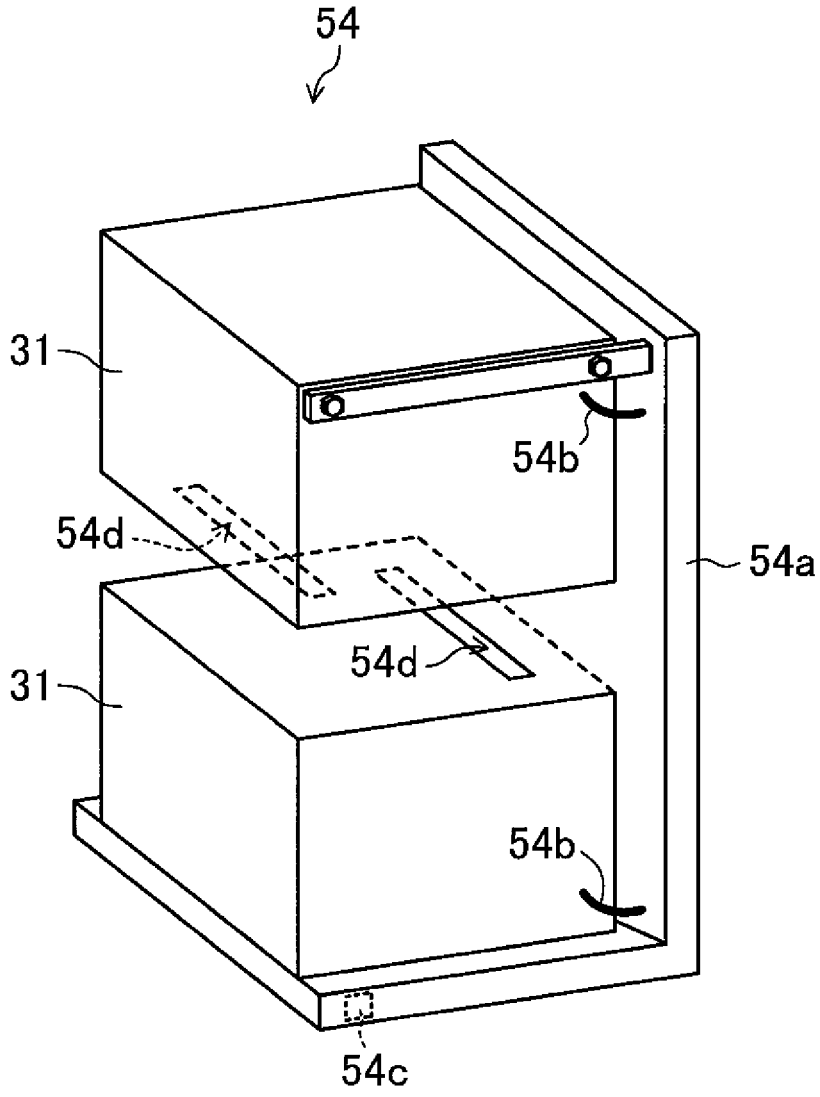
FIG. 7 is a schematic perspective view illustrating the appearance of an additional storing unit.

As shown in FIG. 7, the additional storing unit 54 includes, for example, two storing modules 31 and 31, which are stacked one above the other with a space interposed therebetween, and a second frame 54*a* supporting these storing modules 31. Electrical wiring groups 54*b* led out of the front of the storing modules 31 are electrically connected to a relay terminal 54*c* of the second frame 54*a*. The additional storing unit 54 is attached to the frame fixing unit 72*a* via the second frame 54*a*.

Both of the collection cassette 53 and the additional storing unit 54 are attachable to the frame fixing unit 72*a*, thereby exhibiting excellent convenience.

Openings 54*d*, through which banknotes are in and out, are provided in the lower surface of the upper storing module 31 and the upper surface of the lower storing module 31 to be spaced apart from each other at the front and back. Thus, when the additional storing unit 54 is attached to the chamber 72 for an optional attachment, as shown in FIGS. 4E and 4F, each of the two storing modules 31 is connected to a diverting path 4119, which extends to the front in the front-back direction from the lower end of the transport path 431 and enters the space between the both storing modules 31 and 31, via the above-described allocator 433.

The depositing unit 21, the dispensing unit 23, the recognition unit 25, the processor-side transport unit 41, the banknote storing unit 3, the safe-side transport unit 43, etc., which have been described above, as well as the escrow unit 51, the collection cassette 53, and the additional storing unit 54, which are the optional units, are controlled by the control unit 513, thereby executing various types of processing such as depositing/dispensing processing for handling banknotes.

Configuration for Controlling Operation of Banknote Handling Apparatus 1

Figure 8:
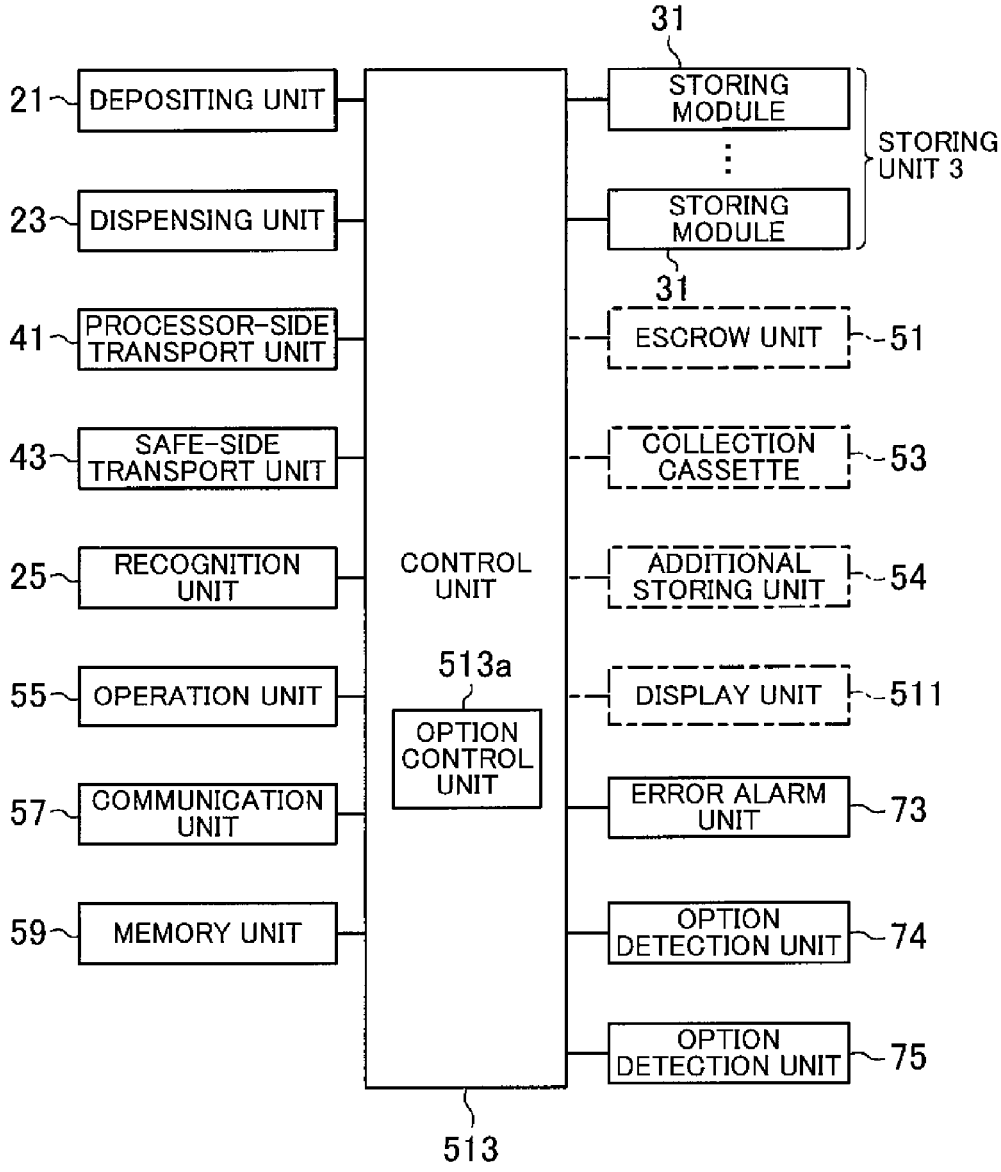
FIG. 8 is a block diagram illustrating the schematic configuration of operation control of the banknote handling apparatus.

FIG. 8 illustrates a configuration for controlling the operation of the banknote handling apparatus 1. The control unit 513 is connected to the depositing unit 21, the dispensing unit 23, the banknote storing unit 3 including the plurality of storing modules 31, the processor-side transport unit 41, and the safe-side transport unit 43 to allow signal transmission. The control unit 513 is also connected to various sensors (not shown) functioning to detect the banknotes transported through the transport path. Detection signals of the various sensors are input to the control unit 513. The control unit 513 outputs control signals based on the input detection signals, etc. The units 21, 23, 3, 41, and 43 operate in response to the control signals.

The control unit 513 is further connected to the recognition unit 25, the operation unit 55, a communication unit 57, and a memory unit 59. The memory unit 59 stores the number of the banknotes stored in the banknote handling apparatus 1 on the denomination-by-domination basis, or the inventory amount, which is the amount of money. The memory unit 59 stores the inventory amount of each storing module 31.

The communication unit 57 is connected to the higher-ranking terminal T wired or wirelessly to allow signal transmission. The communication unit 57 receives command signals from the higher-ranking terminal T and outputs the signals to the control unit 513. The operation unit 55 outputs the command signals in accordance with operation of an operator to the control unit 513. The control unit 513 controls the depositing unit 21, etc. based on these command signals so that the banknote handling apparatus 1 executes various types of processing. A display unit 511 is as an optional device, connected to the control unit 513, and displays information on the operation, control, etc. of the banknote handling apparatus 1.

The control unit 513 is further connected to an error alarm unit 73, an option detection unit 74, and an option detection unit 75. The option detection unit 74 detects attachment of the escrow unit 51. The option detection unit 75 detects attachment of the collection cassette 53 or the additional storing unit 54. The error alarm unit 73 notifies an error under predetermined conditions. The error alarm unit 73 is, for example, a segment or dot matrix display (see also FIG. 2). The error alarm unit 73 displays error codes which are alphameric characters of predetermined digits. The option detection unit 75, etc. will be described later.

In particular, this control unit 513 of the banknote handling apparatus 1 includes an option control unit 513*a* enabling control corresponding to the attached and unattached states of an optional unit such as the escrow unit 51.

Since conventional banknote handling apparatuses have been mounted firmware for each hardware, there was a need to change a control program and replace the entire firmware with another one when an optional unit is attached or detached.

By contrast, this banknote handling apparatus 1 mounts in the firmware 70 in advance, control programs corresponding to the unattached state, or the attached states of the optional units, i.e., the escrow unit 51, the collection cassette 53, and the additional storing unit 54, which are attachable to the portion 71 for an optional attachment and the chamber 72 for an optional attachment (i.e., the six states shown in FIGS. 4A-4F). The option control unit 513*a* includes the common firmware 70 corresponding to the unattached state and the attached states.

Figure 9:
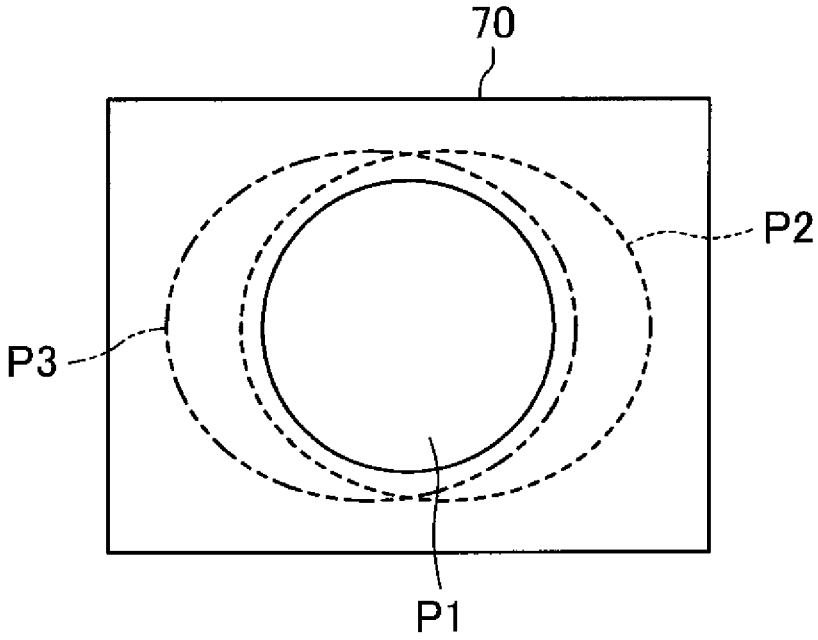
FIG. 9 is a conceptual diagram of a control program mounted in firmware.

FIG. 9 is a conceptual diagram of control programs related to the escrow unit 51 and the collection cassette 53 out of the control programs mounted in the firmware 70. Reference character P1 denotes a control program performing control corresponding to the unattached state. Reference character P2 denotes a control program performing control corresponding to the attached state of the escrow unit 51. Reference character P3 denotes a control program performing control corresponding to the attached state of the collection cassette 53.

The various types of processing in the unattached and attached states largely have in common, basic control such as control of the transport unit 41, the recognition unit 25, the banknote storing unit 3, etc. For example, the control program P2 for the attached state of the escrow unit 51 includes the control program P1 for the unattached state. A control program, into which control etc. of the second diverter 4111 is partially incorporated, is added to the existing control program. Similarly, the control program P3 for the attached state of the collection cassette 53 largely includes the control program P1 of the unattached state. Although not shown, this is applicable to a control program related to the additional storing unit 54.

Therefore, the control programs corresponding to the attached states of the optional units are mounted in the firmware in advance for common use, thereby improving the efficiency and reducing the costs in the program development, the firmware fabrication, etc.

Processing Function of Banknote Handling Apparatus 1

The banknote handling apparatus 1 has various processing functions to recognize and handle the banknotes. Out of the processing functions, the processing functions depending on the attached and unattached states of the optional unit will be described below.

Direct Depositing Processing

Direct depositing processing is processing of depositing (storing) the banknotes to the banknote handling apparatus 1. The banknotes put in the inlet 211 are stored in any one of the storing modules 31 in accordance with the recognition by the recognition unit 25 and predetermined allocation for storing.

Figure 10:
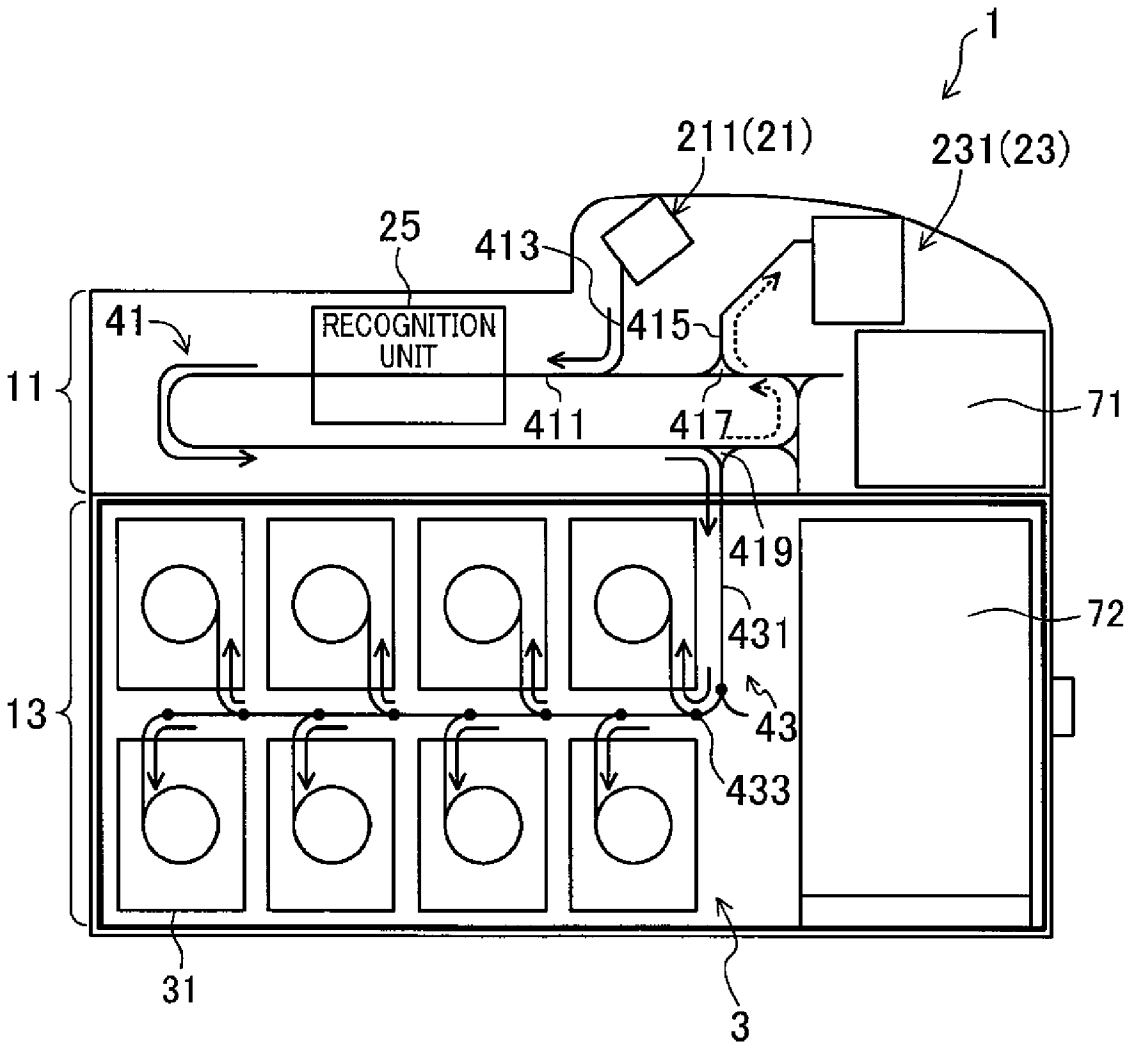
FIG. 10 illustrates one of processing functions of the banknote handling apparatus.

FIG. 10 illustrates the operation of the banknote handling apparatus 1 in the direct depositing processing. A command for starting the depositing processing is input to the banknote handling apparatus 1 by, for example, the operation of the higher-ranking terminal T, with the banknote to be deposited put in the inlet 211. As indicated by arrows (solid lines) in the figure, the depositing unit 21 feeds out the banknotes at the inlet 211 one by one. The processor-side transport unit 41 transports the banknotes to the recognition unit 25. Then, the recognition unit 25 recognizes the banknotes.

Normal banknotes are transported by the processor-side transport unit 41 from the loop transport path 411 through the first diverter 419 to the safe-side transport unit 43. The safe-side transport unit 43 stores the normal banknotes in predetermined ones of the storing modules 31 in accordance with the recognition by the recognition unit 25 and the predetermined allocation for storing. That is, the normal banknotes are stored in any of the storing modules 31 in accordance with the denomination or the fitness.

Banknotes to be rejected are, as indicated by arrows (broken lines), transported by the processor-side transport unit 41 from the loop transport path 411 through the diverter 417 to the dispensing path 415. Then, the banknotes to be rejected are put out to the outlet 231. The banknotes to be rejected, which appear in the depositing processing, are put in the inlet 211 again for further recognition.

Overflow banknotes are put out to the outlet 231. Where the collection cassette 53 is attached to the banknote handling apparatus 1, the overflow banknotes are stored in the collection cassette 53. After the end of the depositing processing, the inventory amounts stored in the memory unit 59 is updated. The control unit 513 updates the information (e.g., denomination and fitness) of the banknotes stored in the storing modules 31 after the end of the depositing processing.

Depositing Processing

Depositing processing is performed where the escrow unit 51 is attached to the banknote handling apparatus 1. In the depositing processing, banknotes are not immediately stored in the storing modules 31, but stored once in the escrow unit 51, and then stored in predetermined ones of the storing modules 31 with reference to a counting result.

Figure 11:
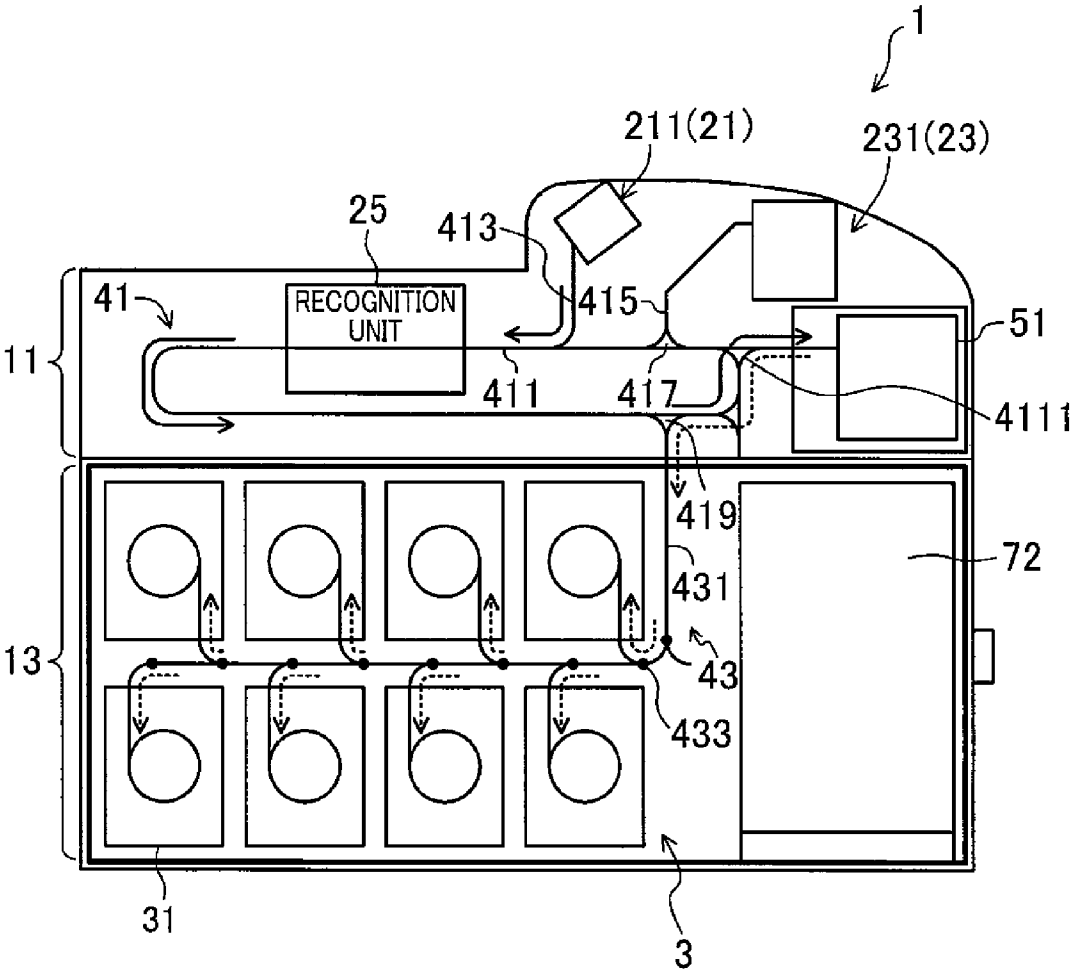
FIG. 11 illustrates one of processing functions of the banknote handling apparatus.

FIG. 11 illustrates example operation of the depositing processing. In this case, the normal banknotes are, as indicated by arrows (solid lines) in the figure, transported from the loop transport path 411 through the second diverter 4111 to the escrow unit 51, and stored in the escrow unit 51. The banknotes to be rejected are put out to the outlet 231.

Then, when all the banknotes put in the inlet 211 are fed out and the recognition of all the banknotes to be deposited is complete, for example, the higher-ranking terminal T displays the counting result. The operator confirms the counting result, and performs predetermined storing operation at the higher-ranking terminal T. As indicated by arrows (broken lines), the escrow unit 51 feeds out the stored banknotes one by one. The processor-side transport unit 41 transports the banknotes from the loop transport path 411 through the first diverter 419 to the safe-side transport unit 43.

The safe-side transport unit 43 stores the banknotes in the storing modules 31 on a denomination-by-denomination basis or a fitness-by-fitness basis in accordance with the recognition by the recognition unit 25 and the predetermined allocation for storing. When the operator performs not storing operation but predetermined cancel operation, the banknotes stored in the escrow unit 51 are put out to the outlet 231.

The control unit 513 updates the inventory amounts of the storing modules 31, which are stored in the memory unit 59, after the end of the depositing processing. The control unit 513 also updates the information (e.g., denomination and fitness) of the banknotes stored in the storing modules 31 after the end of the depositing processing.

Storing/Return Processing

Storing processing and return processing are performed where the escrow unit 51 is attached to the banknote handling apparatus 1.

The storing processing includes processing of storing the banknotes stored in the escrow unit 51 in the storing modules 31, and processing of storing the banknotes in the collection cassette 53 where the collection cassette 53 is attached to the banknote handling apparatus 1.

Figure 12:
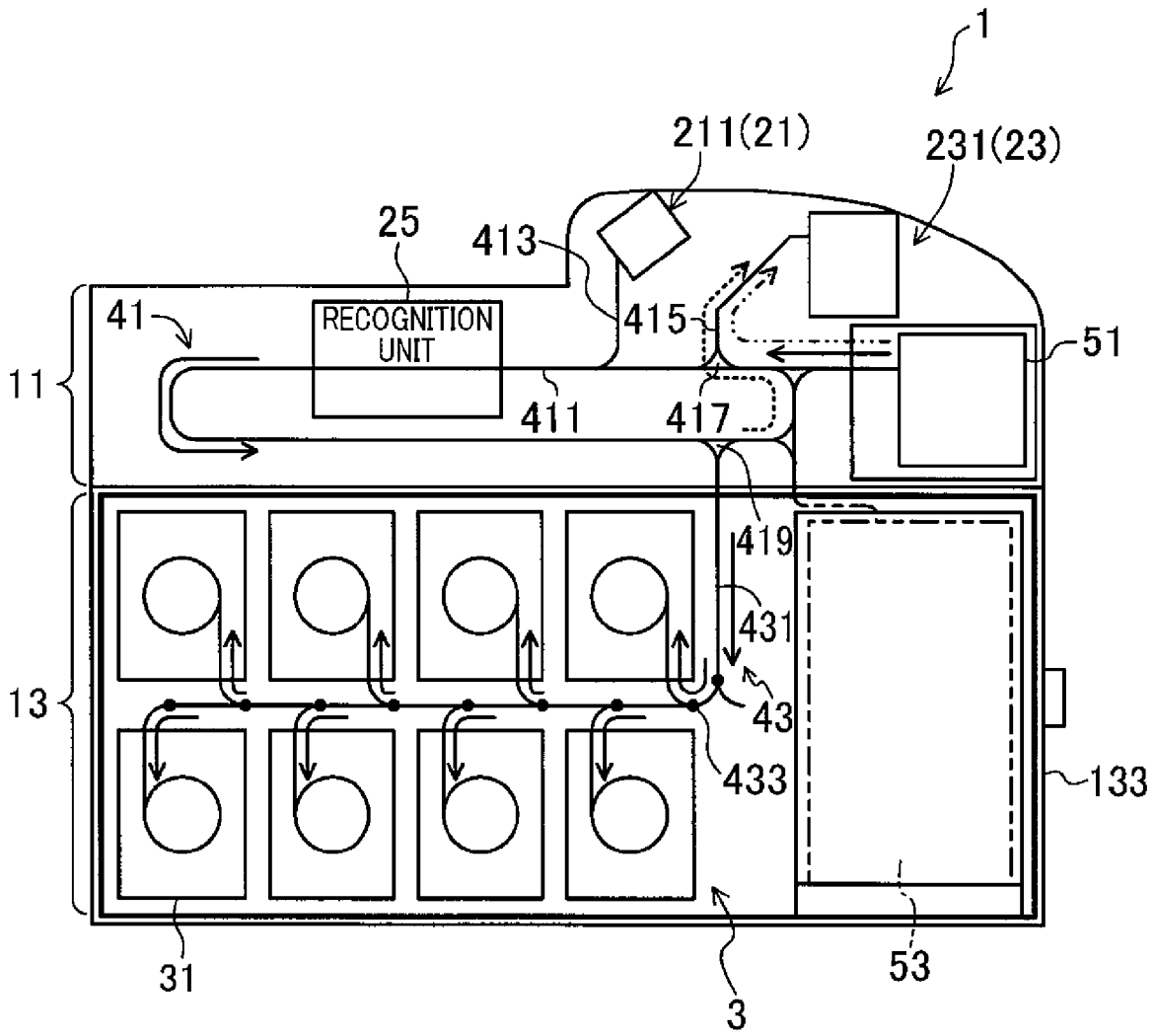
FIG. 12 illustrates one of processing functions of the banknote handling apparatus.

FIG. 12 illustrates the operation of the processing. For example, predetermined operation is performed at the higher-ranking terminal T, thereby starting the storing processing. When the storing processing starts, the escrow unit 51 feeds, as indicated by arrows (solid lines) in the figure, banknotes to the processor-side transport unit 41. The fed banknotes are transported by the processor-side transport unit 41 to the recognition unit 25 for recognition. Based on the recognition, the recognized banknotes are sent through the processor-side transport unit 41 and the safe-side transport unit 43 and stored in predetermined ones of the storing modules 31.

Banknotes not to be transported to the storing modules 31, which include the banknotes to be rejected, and banknotes unable to be stored since the corresponding storing module 31 for storage is full, are transported to and stored in the collection cassette 53, is the collection cassette 53 is provided. If not, the banknotes are, as indicated by an arrow (a broken line), put out to the outlet 231.

The return processing is processing of putting out the banknotes stored in the escrow unit 51 to the outlet 231. For example, predetermined operation is performed at the higher-ranking terminal T, thereby starting the return processing. When the return processing starts, the escrow unit 51 feeds, as indicated by an arrow (a dashed double dotted line), the banknotes to the processor-side transport unit 41. The fed banknotes are not transported to the recognition unit 25, but put out to the outlet 231 through the shortest path.

Dispensing Processing

Dispensing processing is processing of dispensing the banknotes from the corresponding one of the storing modules 31 for recognition and paying out the fit notes.

Figure 13:
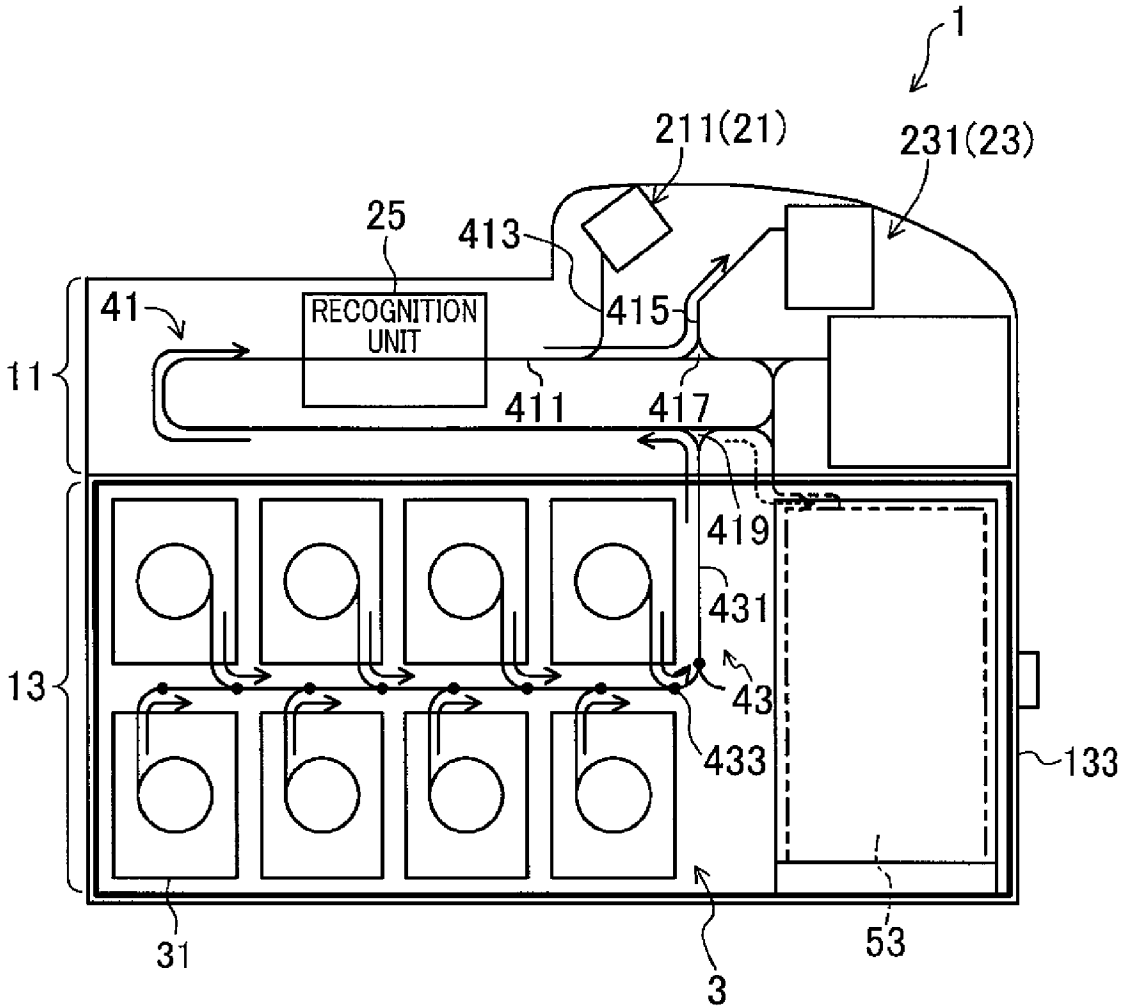
FIG. 13 illustrates one of processing functions of the banknote handling apparatus.

FIG. 13 illustrates the operation of the processing. For example, predetermined dispensing operation of designating the dispensed amount and automatically setting the combination of the denomination and the number of the banknotes forming the minimum number of the banknotes, or directly designating the denomination and the number of the banknotes is performed at the higher-ranking terminal T, thereby starting the dispensing processing. As indicated by arrows (solid lines) in the figure, the designated number of the banknotes of the designated denomination are fed out of the storing modules 31. The safe-side transport unit 43 transports the fed banknotes to the processor-side transport unit 41. The processor-side transport unit 41 transports the banknotes to the recognition unit 25, and then to the dispensing unit 23 after the end of the recognition by the recognition unit 25. Then, the banknotes are paid out to the outlet 231.

Where the banknotes to be rejected appear in the middle of the dispensing processing, and the collection cassette 53 is available, the banknotes to be rejected are, as indicated by an arrow (a broken line), transported to and stored in the collection cassette 53. After that, the series of processing is repeated until the designated number of the banknotes are paid out.

Where the collection cassette 53 is not available, the banknotes to be rejected are also paid out to the outlet 231. In this case, substitute banknotes for the banknotes to be rejected are not dispensed again, and an alarm notifying the fact is given to the operator.

After the end of the dispensing processing, the control unit 513 updates the inventory amounts of the storing modules 31, which are stored in the memory unit 59, and updates the information on the banknotes stored in the storing modules 31. That is, the control unit 513 deletes the information on the banknotes fed out of the storing modules 31.

Collecting Processing

Collecting processing is processing of transporting the banknotes from one of the storing modules 31, which stores the banknotes of the designated denomination, to the collection cassette 53. That is, the collecting processing is performed where the collection cassette 53 is available.

Figure 14:
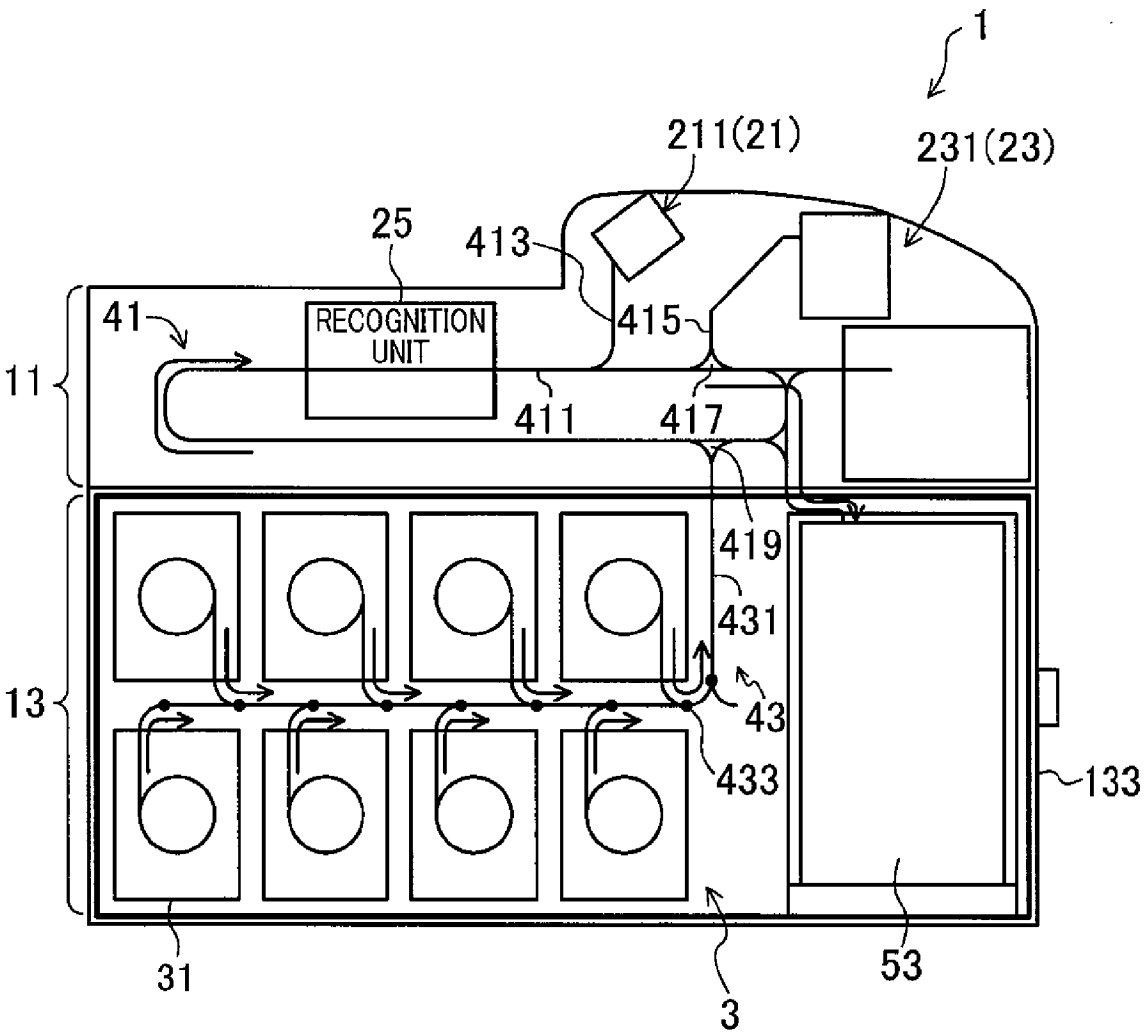
FIG. 14 illustrates one of processing functions of the banknote handling apparatus.

FIG. 14 illustrates the operation of the processing. For example, predetermined collecting operation of designating the denomination and the number of the banknotes is performed at the higher-ranking terminal T, thereby starting the collecting processing. As indicated by arrows (solid lines) in the figure, the designated number of the banknotes of the designated denomination are fed out of the storing modules 31. The safe-side transport unit 43 transports the fed banknotes to the processor-side transport unit 41. The processor-side transport unit 41 transports the banknotes to the recognition unit 25, and then to the collection cassette 53 after the end of the recognition by the recognition unit 25.

Reconciliation Processing

Reconciliation processing is processing for allowing the storing modules 31 to confirm the stored banknotes. Basically, all the banknotes stored in the storing modules 31 are fed out, and then the fed banknotes are one by one recognized and returned to the original ones of the storing modules 31.

The reconciliation processing is performed, for example, when opening of the door for taking one of the storing modules 31 out of the apparatus is detected. The reason follows. When the storing module 31 is open, the number, etc. of the banknotes stored in the storing module 31 becomes indefinite to cause inconsistency between the actual number of the banknotes stored in the storing module 31 and the inventory amount stored in the memory unit 59 of the banknote handling apparatus 1. Where any of the storing modules 31 is replaced with another one, the reconciliation processing is performed.

The reconciliation processing is also performed in occurrence of jam of the banknotes (i.e., an error) around the opening of any of the storing modules 31 in the depositing processing. The reason follows. When the banknotes at the jam around the opening are extracted, for example, by a hand at the occurrence of the error although a sensor provided around the storing module 31 has been detected the pass of the banknotes, or on the other hand, when the banknotes at the jam are put in the storing module 31 by a hand although the sensor does not detect the pass of the banknotes; the number, etc. of the banknotes stored in the storing module 31 becomes indefinite.

The reconciliation processing is also performed when retry occurs in the dispensing processing. The "retry" means that the reel is rewound to feed the banknotes again when the banknotes are to be fed out of one of the winding storing modules 31 but are not apart from the tape. This is because, at the rewinding of the reel, the banknotes may overlap to make the number of the banknotes fed out of the storing module 31 indefinite, in other words, the number of the banknotes stored in the storing module 31 indefinite.

The inconsistency between the actual number of the banknotes and the inventory amount is, in other words, the state where the banknotes in any of the storing modules 31 cannot be managed, and the storing module 31 is not normal (i.e., abnormal). The reconciliation processing is also performed, for example, when the execution of the reconciliation processing is designated at the higher-ranking terminal T. The reconciliation processing may be periodically performed based on a predetermined schedule. The reconciliation processing may be performed individually in each of the storing modules 31, or sequentially in all of the storing modules 31.

Except for the above-described examples where the execution of the reconciliation processing is designated and where the periodical reconciliation processing is performed, the control unit 513 changes a storage flag, which usually indicates "normal," to "abnormal" upon detection of a condition requiring the reconciliation processing. The storage flag of any of the storing modules 31 requiring the reconciliation processing is held "abnormal" until the reconciliation processing is executed, and changed to "normal" when the reconciliation processing is executed.

Figure 15:
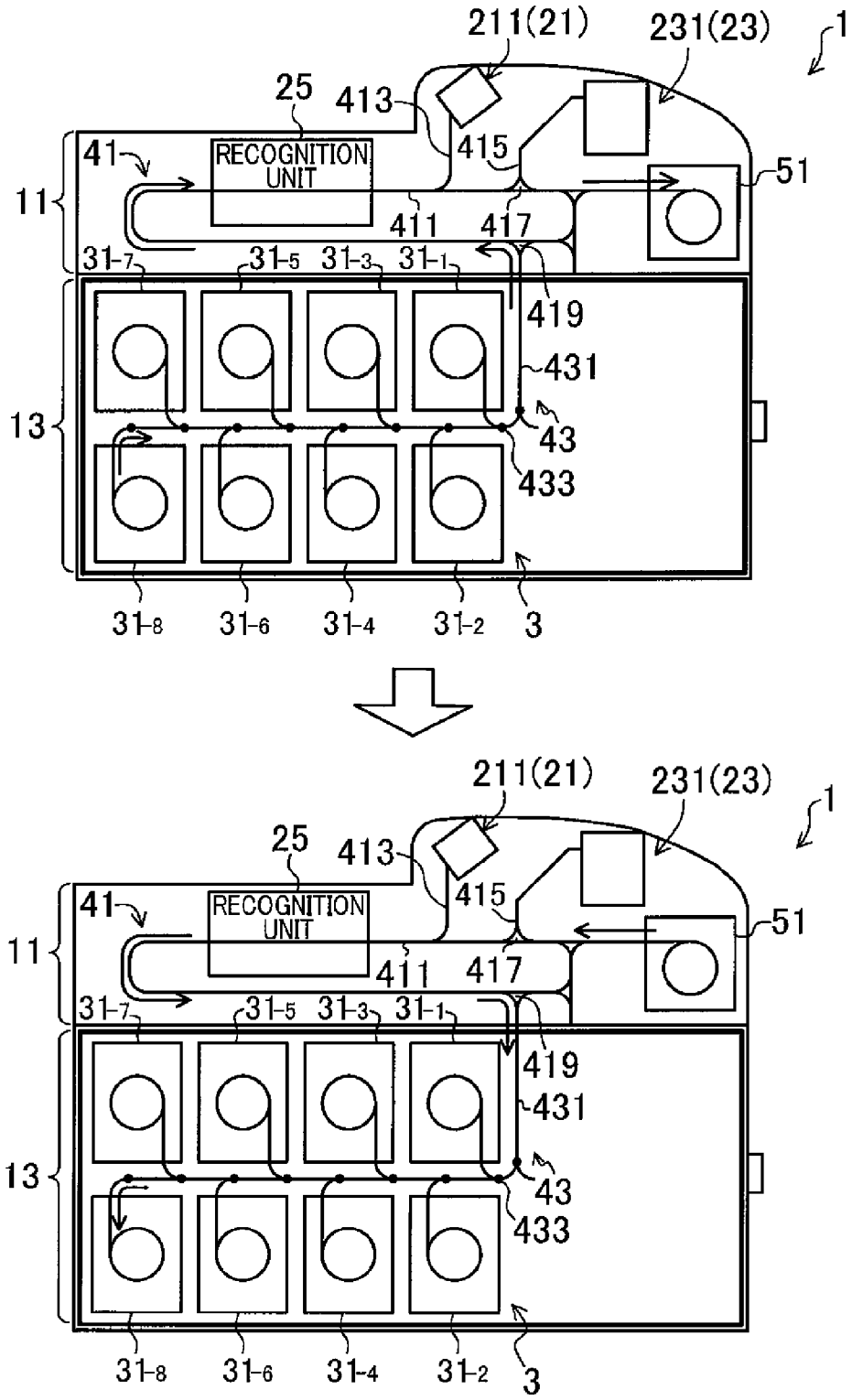
FIG. 15 illustrates one of processing functions of the banknote handling apparatus.

FIG. 15 illustrates operation of the banknote handling apparatus 1 in the reconciliation processing. At least the escrow unit 51 is attached to the banknote handling apparatus 1 includes. As shown in the upper figure of FIG. 15, the banknote handling apparatus 1 feeds the banknotes to be reconciled one by one out of one of the storing modules 31 (the eighth storing module $31_{_8}$ in FIG. 15), and recognizes the banknotes at the recognition unit 25. Then, the banknote handling apparatus 1 stores the fed banknotes at the escrow unit 51. As such, all the banknotes in the storing module 31 are fed out so that the storing module 31 becomes empty.

When all of the banknotes stored in the storing module 31 to be reconciled are stored in the escrow unit 51, as shown in the lower figure of FIG. 15, the banknotes are fed out of the escrow unit 51 one by one, and transported through the loop transport path 411 to the recognition unit 25. After being recognized again by the recognition unit 25, normal banknotes are stored in the original the storing module 31, i.e., the storing module 31 to be reconciled.

As such, the denomination and the number of the banknotes stored in the storing module 31 is confirmed, and the information on the inventory amount and the banknotes of the storing module 31, which is stored in the memory unit 59, is updated. Where the reconciliation processing is performed in all the plurality of storing modules 31, the reconciliation processing is performed sequentially in the plurality of storing modules 31. Every time when the reconciliation processing is completed, the information on the inventory amount and the banknotes of the storing module 31, which is stored in the memory unit 59, is updated. When the reconciliation processing is complete, the storage flag of the storing module 31 is changed from "abnormal" to "normal."

FIG. 16 illustrates controllable processing according to the attached and unattached states of the optional units. Where the optional unit is the additional storing unit 54, in substance, the number of the storing module 31 increases. The controllable processing types are almost the same as those of the unattached state where none of the escrow unit 51 and the collection cassette 53 is attached.

The firmware 70 functions to execute control programs corresponding to the states by switching modes.

Specifically, the banknote handling apparatus 1 performs processing operation by conjunction of the processor 11 and the safe 13. As shown in FIGS. 4A-4F, there are six different patterns of hardware configurations formed by combinations of the presence or absence of the escrow unit 51 in the processor 11, and the presence or absence of the collection cassette 53 or the additional storing unit 54 in the safe 13.

The firmware 70 functions to execute control programs corresponding to the six patterns, and switchable among the six patterns.

Specifically, first, with respect to control in the processor 11, the firmware 70 is switchable between two modes. FIGS. 4A, 4C, and 4E show a mode (i.e., a second mode) of performing control corresponding to the unattached state of the escrow unit 51. FIGS. 4B, 4D, and 4F show a mode (i.e., a first mode) of performing control corresponding to the attached state of the escrow unit 51.

Furthermore, with respect to control in the safe 13, the firmware 70 is switchable among modes. FIGS. 4C and 4D show a mode (i.e., a third mode) of performing control corresponding to the attached state of the collection cassette 53. FIGS. 4E and 4F show a mode (i.e., a fourth mode) of performing control corresponding to the attached state of the additional storing unit 54. FIGS. 4A and 4B show a mode (i.e., a fifth mode) of performing control corresponding to the unattached state of the collection cassette 53 and the additional storing unit 54.

The modes are switchable, for example, via the higher-ranking terminal T and the operation unit 55.

In this banknote handling apparatus 1, even when an optional unit is attached, etc., and the hardware configuration changes, control corresponding to the configuration of the hardware is performed simply by switching the modes. This reduces the operational time.

Furthermore, the banknote handling apparatus 1 is designed to virtually reduce the hardware configuration by utilizing the setting function of the firmware 70.

Specifically, where an optional unit such as the escrow unit 51 is attached, the control corresponding to the unattached state is performed by switching the firmware 70 to the mode of performing the control corresponding to the unattached state.

Assume that, for example, the use of an optional unit becomes no more desired in attaching the optional unit due to a trouble, etc. of the optional unit. In this case, the banknote handling apparatus 1 copes with this simply by switching the modes without detaching the optional unit, thereby improving the efficiency in the operation.

Appropriate operation is performed for attaching and detaching an optional unit. Specifically, the attached and unattached states of the optional unit are automatically detected based on presence or absence of electrical connection or communications of the optional unit. When an inappropriate mode is set, the error is notified.

Specifically, the option detection unit 74 detects attachment of the escrow unit 51 based on presences or absence of electrical connection. When the escrow unit 51 is attached to the portion 71 for an optional attachment, the electrical wiring group 51*d* of the escrow unit 51 is connected to the electrical wiring group at the processor 11 side. At this time, a current change etc. occurs, which is detected by the option detection unit 74, and then the attachment of the escrow unit 51 is detected.

Similarly, the option detection unit 75 detects attachment of the collection cassette 53 or the additional storing unit 54. When the collection cassette 53, etc., is attached to the chamber 72 for an optional attachment, the electrical wiring group of the collection cassette 53, etc. is connected to the electrical wiring group at the safe 13 side. At this time, a current change etc. occurs, which is detected by the option detection unit 75, and then the recognition and the attachment of the collection cassette 53, etc. is detected.

Alternatively, the attachment of the escrow unit 51 may be detected, or the attachment of the collection cassette 53 or the additional storing unit 54 may be detected based on presence and absence of communications. When the escrow unit 51 is attached to the portion 71 for an optional attachment, or the collection cassette 53 or the additional storing unit 54 is attached to the chamber 72 for an optional attachment, communications with the escrow unit 51, the collection cassette 53 or the additional storing unit 54 become possible. Therefore, based on the presence and absence of the communications with the escrow unit 51, the collection cassette 53, or the additional storing unit 54, the attachment of the escrow unit 51, etc. is detected.

When a mode not matching the optional unit is set, the error is notified.

Figure 17:
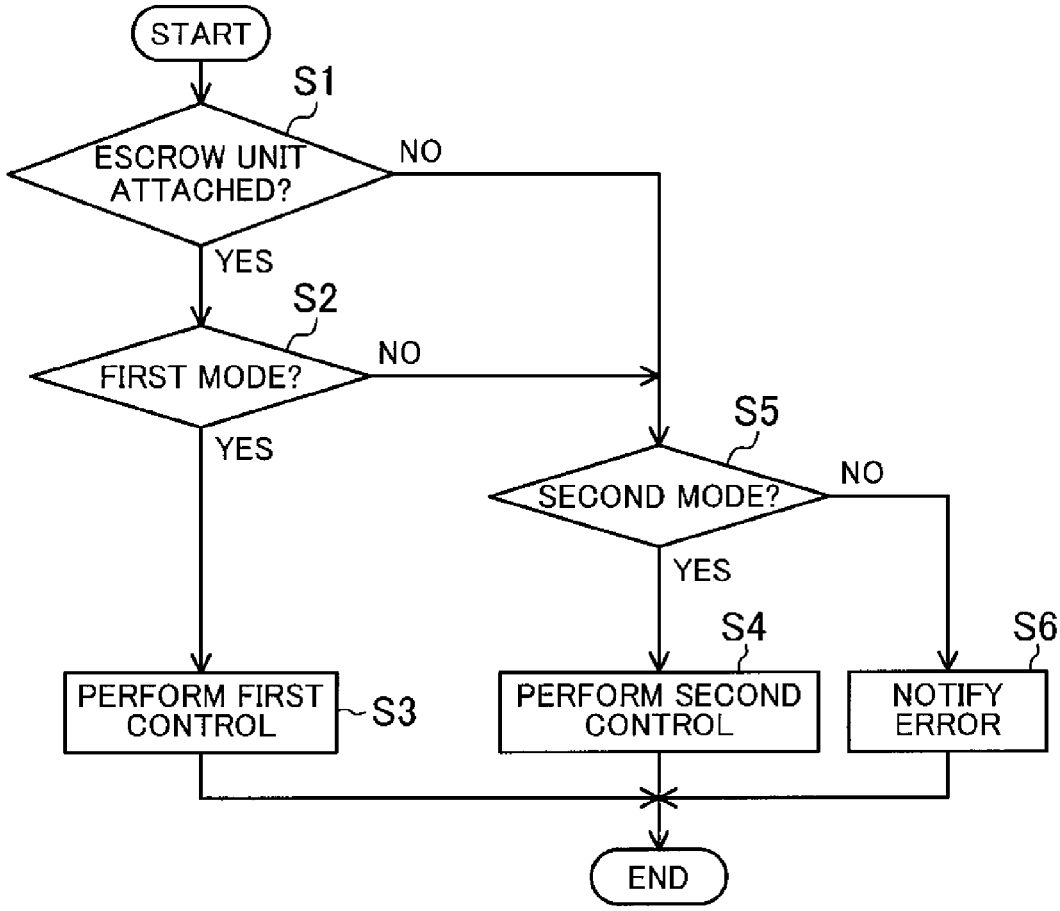
FIG. 17 is a flow chart of main operation for switching between modes.

FIG. 17 illustrates a flow of main operation for switching the modes related to the escrow unit 51. First, the option detection unit 74 detects whether or not the escrow unit 51 is attached (step S1).

Where the escrow unit 51 is attached (Yes in step S1), and the first mode corresponding to the attached state of the escrow unit 51 is selected (Yes in step S2), first control corresponding to the first mode is performed (step S3). On the other hand, where the escrow unit 51 is not attached (No in step S1), and the second mode is selected (Yes in step S5), the control (i.e., second control) corresponding to the unattached state of the escrow unit 51 is performed (step S4).

Where the escrow unit 51 is attached (Yes in step S1), the second mode corresponding to the unattached state of the escrow unit 51 is selected (No in step S2 and Yes in step S5), the hardware configuration is virtually reduced, and the second control corresponding to the unattached state of the escrow unit 51 is performed (step S4).

Where the mode is none of the first mode and the second mode (No in step S2 and No in step S5), i.e., a mismatching mode is set, the error is notified through the error alarm unit 73 (step S6).

Figure 18:
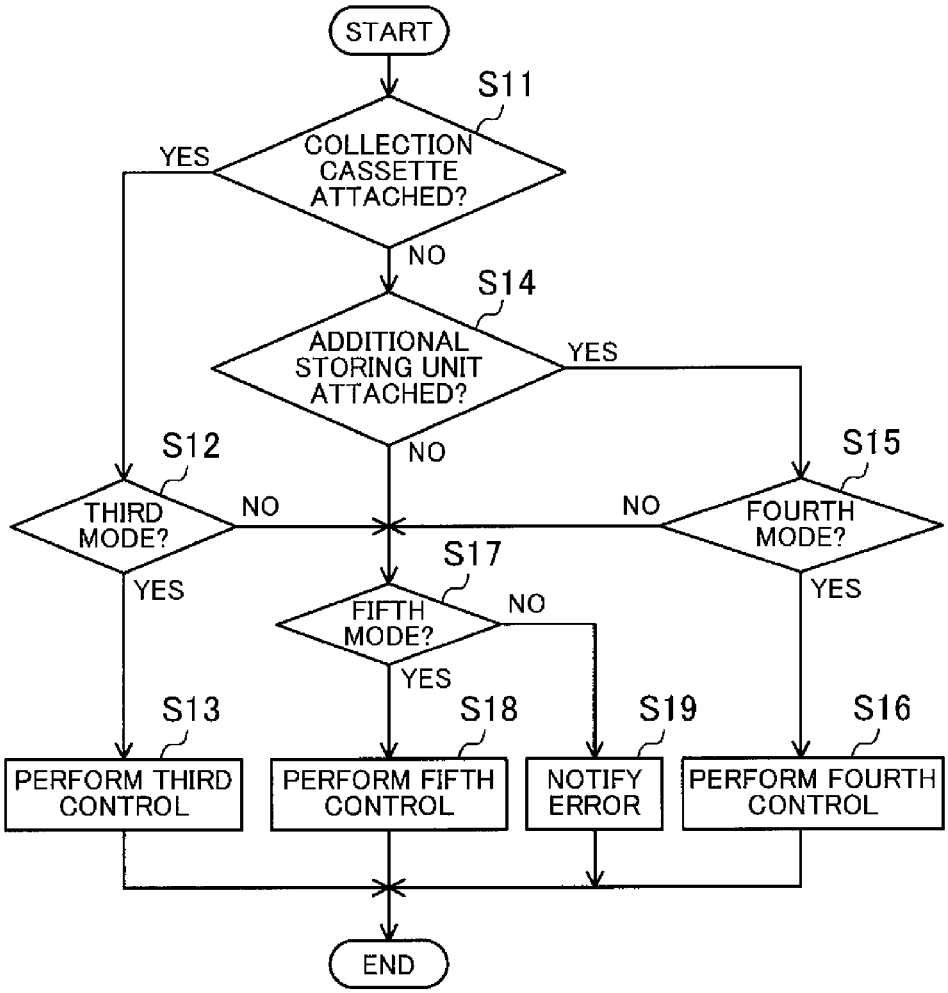
FIG. 18 is a flow chart of main operation for switching among modes.

FIG. 18 illustrates a flow of main operation for switching the modes related to the collection cassette 53 and the additional storing unit 54. First, the option detection unit 75 detects whether or not the collection cassette 53 is attached (step S11).

Where the collection cassette 53 is attached (Yes in step S11), and the third mode corresponding to the attached state of the collection cassette 53 is selected (Yes in step S12), third control corresponding to the third mode is performed (step S13). On the other hand, where the collection cassette 53 is not attached (No in step S11), the option detection unit 75 detects whether or not the additional storing unit 54 is attached (step S14).

Where the additional storing unit 54 is attached (Yes in step S14), and the fourth mode corresponding to the attached state of the additional storing unit 54 is selected (Yes in step S15), fourth control corresponding to the fourth mode is performed (step S16).

Where the collection cassette 53 is attached (Yes in step S11), or the additional storing unit 54 is attached (Yes in step S14), and the fifth mode corresponding to the unattached state of the collection cassette 53, etc. is selected (Yes in step S17), the hardware configuration is virtually reduced, and fifth control corresponding to the unattached state of the collection cassette 53, etc. is performed (step S18).

Where none of the collection cassette 53 and the additional storing unit 54 is attached (No in steps S11 and S14), and the fifth mode is selected (Yes in step S17), the fifth control is performed (step S18).

In a mismatching mode, the error is notified through the error alarm unit 73 (step S19). Specifically, the error is notified, when the fifth mode is not selected although none of the collection cassette 53 and the additional storing unit 54 is attached (No in steps S11, S14, and S17), when none of the third mode and the fifth mode is selected although the collection cassette 53 is attached (No in steps S12 and S17), or when none of the fourth mode and the fifth mode selected although the additional storing unit 54 is attached (No in steps S15 and S17).

As such, the banknote handling apparatus 1 efficiently accepts the attachment of an optional unit.

In the banknote handling apparatus 1, the processor 11 and the safe 13 have different control systems. Specifically, each of the processor 11 and the safe 13 has an option control unit, which includes common firmware, which corresponds to presence and absence of the optional unit and is switchable between/among the modes.

On the other hand, since the banknote handling apparatus 1 operates due to conjunction of the processor 11 and the safe 13, and thus may include an option control unit performing control by conjunction of the processor 11 and the safe 13. That is, the banknote handling apparatus 1 may have common firmware, which corresponds to presence and absence of the optional unit, and may be switchable in accordance with presence and absence of the optional unit.

Assume that, for example, the escrow unit 51 is an escrow unit for depositing or an escrow unit for dispensing. The control of the entire banknote handling apparatus 1 is little different between the attached state of the collection cassette 53, and the attached state of the additional storing unit 54 to the chamber 72 for an optional attachment. However, common firmware corresponding to the both control may be included.

Example Control Related to Reconciliation Processing

In the middle of the above-described reconciliation processing, the recognition unit 25 performs recognition. As a result, some of the banknotes may be recognized as the banknotes to be rejected. The reconciliation processing cannot be completed unless the banknotes, which have been recognized as the banknotes to be rejected in the reconciliation processing, are distinguished from the other normal banknotes. However, the collection cassette 53 may not be attached to the banknote handling apparatus 1. Where the collection cassette 53 is not attached, the banknotes to be rejected cannot be stored in the collection cassette 53 and need to be paid out to, for example, the outlet 231. However, if the banknotes are paid out of the apparatus, strict cash management cannot be maintained without the presence of the person in charge or a manager, etc. who is a management supervisor. It takes a long time to complete the reconciliation processing. In particular, it takes a considerable time to complete the reconciliation processing of all the plurality of storing modules 31. Thus, such reconciliation processing is sometimes performed outside business hours. Therefore, the banknotes cannot be paid out of the apparatus to maintain the strict cash management.

To address the problem, the banknote handling apparatus 1 stops the reconciliation processing when the banknotes to be rejected are recognized in the middle of the reconciliation processing. Then, the control unit 513 puts an "incomplete" flag indicating that the reconciliation processing is incomplete for the corresponding one of the storing modules 31, which stores the banknotes to be rejected.

In short, the banknote handling apparatus according to this disclosure includes at least one storing unit, a depositing unit, a dispensing unit, a control unit, a recognition unit, and an escrow unit.

In the reconciliation processing of confirming the inventory amount of the banknotes stored in the storing unit, the control unit stores once the banknotes fed out of the storing unit in the escrow unit. After all the banknotes in the storing unit are fed out, the control unit stores the banknotes fed out of the escrow unit again in the original storing unit. In the middle of the transport of the banknotes between the storing unit and the escrow unit, the control unit confirms the inventory amount of the banknotes in the storing unit based on the recognition of the banknotes by the recognition unit.

In the middle of the reconciliation processing, when the recognition unit recognizes the banknotes to be rejected, the control unit returns all the banknotes fed out of the storing unit to the original storing unit, and puts for the storing unit, the "incomplete" flag indicating that the reconciliation processing is incomplete.

Specifically, as described above, in the middle of feeding the banknotes out of the storing module 31 to be reconciled and storing them in the escrow unit 51, when the recognition unit 25 recognizes the banknotes to be rejected, the control unit 513 stops the feeding of the banknotes from the storing module 31. At this time, the fed banknotes are stored once in the escrow unit 51. As such, the control unit 513 feeds out the banknotes stored in the escrow unit 51 one by one, and stores the banknotes in the original storing module 31. Then, the control unit 513 sets the "incomplete" flag to the storing module 31. The control unit 513 may not stop feeding the banknotes out of the storing module 31 immediately after the recognition unit 25 recognizes the banknotes to be rejected. After feeding out all the banknotes stored in the storing module 31 and storing the banknotes in the escrow unit 51, the control unit 513 may return the banknotes to the storing module 31.

After storing all the banknotes in the escrow unit 51, when the recognition unit 25 recognizes the banknotes to be rejected in the middle of returning the banknotes from the escrow unit 51 to the original the storing module 31, the returning of the banknotes may continue until all the banknotes are stored in the original storing module 31.

As such, when being recognized in the reconciliation processing, the banknotes to be rejected are not paid out of the outlet 231, strict cash management is maintained. In addition, the banknotes to be rejected also return to the storing modules 31, thereby not requiring an extra storing unit for storing the banknotes to be rejected.

Assume that the reconciliation processing of the plurality of storing modules 31 is sequentially performed. As described above, even after the "incomplete" flag is set for any of the storing modules 31, the reconciliation processing of the other storing modules 31, which are not yet reconciled, is sequentially performed. As a result, regardless of the appearance of the banknotes to be rejected, the reconciliation processing of all the storing modules 31 to be reconciled starts. To address the reconciliation processing for each storing module 31, the "incomplete" flag is also set for each storing module 31.

With respect to the storing module 31 with the "incomplete" flag, since the reconciliation processing is incomplete, the information on the inventory amount and the banknotes of the storing module 31, which is stored in memory unit 59, cannot be updated. Thus, the control unit 513 does not update the information stored in memory unit 59 on the storing module 31 with the "incomplete" flag to hold the information stored in the memory unit 59, i.e., the information as of the time before executing the reconciliation processing. This prevents loss of the information on the storing module 31.

In the banknote handling apparatus 1, assume that the "incomplete" flag is set due to the appearance of the banknotes to be rejected in the reconciliation processing. Even if the full dispensing/depositing processing, which will be described later, is not executed, the subsequent depositing processing and dispensing processing continue. Specifically, the control unit 513 executes the depositing processing and the dispensing processing even when the "incomplete" flag is set. This is because, in the depositing processing and the dispensing processing, the reliability in the depositing dealing and the dispensing dealing can be secured even when the reconciliation processing is incomplete since the recognition by the recognition unit 25 is performed as described above. As such, the depositing processing and the dispensing processing continue after the "incomplete" flag is set, thereby smoothing counter work. In particular, even when the reconciliation processing is automatically performed outside the business hours, and an "incomplete" flag is set at this time, the depositing processing and the dispensing processing continue in the next business hours, thereby smoothly starting the counter work.

While the depositing processing and the dispensing processing continue, the banknote handling apparatus 1 goes down when the banknotes to be rejected appear in the dispensing processing. The down banknote handling apparatus 1 is recovered by executing the full dispensing/depositing processing.

The "full dispensing/depositing processing" is processing of paying out all the banknotes stored in any of the storing modules 31 storing the banknotes to be rejected (i.e., the storing module 31 with the "incomplete" flag) to the outlet 231, and storing all the paid out banknote through the inlet 211 to the original storing module 31.

That is, similar to the dispensing processing of FIG. 13, the full dispensing/depositing processing pays out all the banknotes in the storing module 31 with the "incomplete" flag to the outlet 231, and puts the paid out banknotes into the inlet 211. As such, similar to the direct depositing processing of FIG. 10, the banknotes put in the inlet 211 are fed out one by one, and then stored in the original storing module after being recognized by the recognition unit 25. Such the full dispensing/depositing processing is performed with the presence of the person in charge (e.g., a manager), since the banknotes are paid out of the apparatus. Thus, when being recognized in storing the banknote put in the inlet 211 in the storing module 31, the banknotes to be rejected may be paid out to, for example, the outlet 231. Also, the banknotes to be rejected may be stored once in the escrow unit 51. In other words, such the full dispensing/depositing processing is the reconciliation processing with the presence of the manager.

When an "incomplete" flag is set for any of the storing modules 31, as described above, the depositing processing and the dispensing processing continue, while the control unit 513 allows, for example, the error alarm unit 73 to display an error code. That is, in setting the "incomplete" flag, the control unit 513 notifies the error using the error alarm unit 73. The error code may be displayed by the higher-ranking terminal T and/or the display unit 511. This error code may alert the execution of the full dispensing/depositing processing. When the full dispensing/depositing processing of the storing module 31 with the "incomplete" flag is executed, the "incomplete" flag is cleared.

As described above, for example, in the periodically performed reconciliation processing, the reconciliation processing utilizing the escrow unit 51 is not performed in the storing module 31 with the "incomplete" flag. This is because it is desirable to execute the full dispensing/depositing processing in the storing module 31 with the "incomplete" flag.

In the full dispensing/depositing processing, the banknotes stored in the storing module 31 are once paid out of the apparatus, thereby reducing banknotes to be rejected caused by abnormal transport. Specifically, the banknotes, which are recognized in the reconciliation processing, are those stored in the storing module 31. As described above, since the banknote handling apparatus 1 is the circulation depositing/dispensing machine, the banknotes, which are stored in the storing module 31, are those recognized by the recognition unit 25 as the banknotes not to be rejected in the depositing processing, and stored as the normal banknotes. Although not described, the banknote stored in the storing modules 31 in refilling processing are basically the normal banknotes which are not the banknotes to be rejected. Thus, the banknotes fed out of the storing modules 31 themselves are basically normal. Abnormal transport is the main cause of the determination as the banknotes to be rejected in the reconciliation processing. Specifically, the following banknotes etc., are determined as the banknotes to be rejected.

Figure 19A:
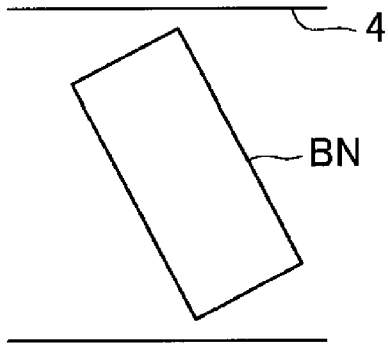
FIG. 19A illustrates example skew of a banknote.

As shown by the example of FIG. 19A, a banknote BN is skewed when being transported along a transport path 4 (skew).

Figure 19B:
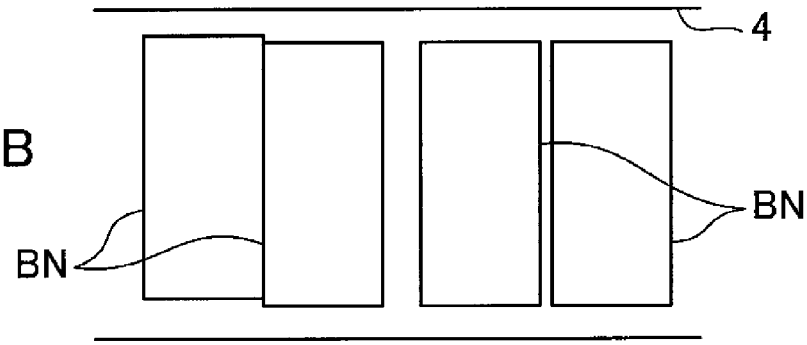
FIG. 19B illustrates example chain of banknotes.

As shown by the two examples of FIG. 19B, a plurality of banknotes BN are transported without any predetermined interval (chain).

Figure 19C:
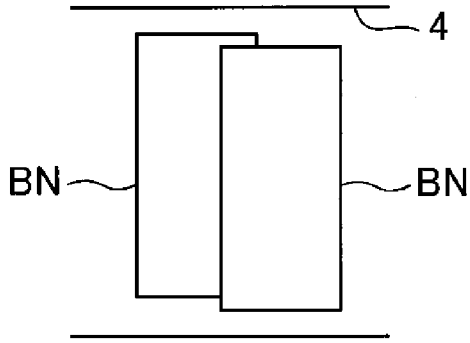
FIG. 19C illustrates example size abnormality in banknotes.

As shown by the example of FIG. 19C, a plurality of banknotes BN partially overlap so that the sizes of the banknotes do not correspond to the recognized denomination (size abnormality).

Figure 19D:
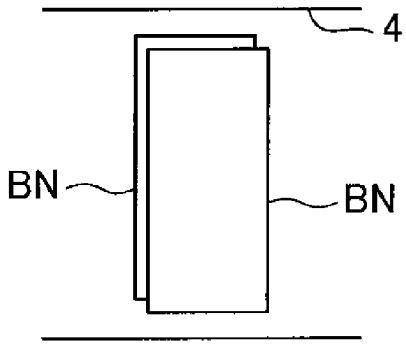
FIG. 19D illustrates example transport of overlapping banknotes.

As the example shown in FIG. 19D, a plurality of banknotes BN overlap and are transported (overlap).

These banknotes to be rejected caused by the abnormal transport are once paid out of the apparatus, and then taken into the apparatus again through the inlet 211. This solves the abnormal transport so that the banknotes are recognized as the normal banknotes.

In particular, the banknote handling apparatus 1 includes, as described above, the winding storing modules 31. Such winding storing modules 31 store the banknotes on a first-in-last-out basis. Thus, the banknote stored first in the storing modules 31 are not paid out in the dispensing processing for a long time, and remain in the storing modules 31. Every time when the reconciliation processing is executed, these banknotes are fed out of the storing modules 31, transported through the transport path, and then stored in the escrow unit 51. After that, the banknotes are fed out of the escrow unit 51, transported through the transport path, and then stored in the storing modules 31. The repeat of the feeding, transport, and storage eventually causes the skew of FIG. 19A, the chain of FIG. 19B, or the state shown in FIG. 20 where a banknote goes to one side of the transport path 4. As such, the banknote handling apparatus 1 including the winding storing modules 31 tends to cause the banknotes recognized as the banknotes to be rejected in the reconciliation processing. However, as described above, when the banknotes to be rejected are recognized in the reconciliation processing, only the reconciliation processing stops, and the banknote handling apparatus 1 does not go down due to the error. Thus, unnecessary error down is avoided. Furthermore, the above-described full dispensing/depositing processing solves the degraded transportation conditions such as the skew, the chain, the one-sided banknotes, etc.

Related to the transportation conditions of the banknotes, in the middle of the reconciliation processing, the recognition unit 25 recognizes the transportation conditions of the banknotes recognized as the banknotes to be rejected, for example, the degraded transportation conditions lower than a predetermined rejection level. In addition, the recognition unit 25 may determine whether or not the transportation conditions are more degraded than a warning level, which is lower than the rejection level. When any of the storing modules 31 includes a predetermined number or more of banknotes under the transportation conditions lower than the warning level, the control unit 513 may set an "incomplete" flag for the storing module 31.

As described above, the winding storing modules 31 may degrade the transportation conditions of the banknotes. For example, the skew and the chain may cause jam of the banknotes, and the skew and the one-sided banknotes may increase the tension of the tapes of the storing modules 31. Where any of the storing modules 31 includes a predetermined number or more of banknotes under the transportation conditions lower than the warning level, the "incomplete" flag is set for the storing module 31. In accordance with the "incomplete" flag, the error alarm unit 73 displays the error code. This promotes the execution of the above-described full dispensing/depositing processing, thereby improving the transportation conditions of the banknotes. This feature is useful to avoid the problems such as jam of the banknotes in advance.

The rejection level and the warning level, which are different levels of the transportation conditions, may be set depending on, for example, the degree of the angle of the skewed banknote at the occurrence of the skew, or, for example, the size of the interval between the banknotes at the occurrence of the chain. With respect to the other factors, the levels may be set similarly.

Recognition and Determination for Rejection in Depositing Processing, Dispensing Processing, and Reconciliation Processing As described above, the banknotes stored in the storing modules 31 by the depositing processing and the refilling processing are basically the normal banknotes, which are not the banknotes to be rejected.

On the other hand, as described above with reference to FIG. 13, the banknote handling apparatus 1 performs the recognition using the recognition unit 25 also in the dispensing processing in view of improving the reliability in the dispensing dealing. In this recognition, some banknotes may be determined as the banknotes to be rejected. Since the banknotes fed out of the storing modules 31 themselves are normal, the determination as the banknotes to be rejected in the dispensing processing is mainly caused by the abnormal transport shown in FIGS. 19A-19D. At the occurrence of the skew shown in FIG. 19A, the chain shown in FIG. 19B, and the size abnormality shown in FIG. 19C of the abnormal transport, the number of the banknotes can be confirmed, and the banknotes themselves are normal. Thus, determination of these banknotes as the banknotes to be rejected in the dispensing processing can be regarded as erroneous determination or unnecessary determination for rejection. If such erroneous determination etc., frequently occurs in the dispensing processing, it is inconvenient for the user.

To address the problem, in the dispensing processing, some of the plurality of factors in recognition by the recognition unit 25 may not be used for the determination as to whether the banknotes are to be rejected, or not to be rejected. This secures the reliability in the dispensing dealing, and avoids the unnecessary determination for rejection.

In short, in the banknote handling apparatus according to this disclosure, each of the storing unit, the dispensing unit, the recognition unit, and the recognition unit includes a setting unit and a control unit. The setting unit determines whether each of the factors in recognition by the recognition unit is a factor used for determination as to whether or not the banknotes are to be rejected, or the non-factor not used in the determination.

The control unit determines whether the banknotes fed out of the storing units are to be rejected or not to be rejected based on the recognition by the recognition unit, and the determination by the setting unit.

Similar to the dispensing processing, in the reconciliation processing, some of the plurality of factors in recognition by the recognition unit 25 may not be used for the determination as to whether the banknotes are to be rejected, or not to be rejected.

Specifically, as shown in FIG. 21, the factors in recognition by the recognition unit 25 may be a plurality of predetermined factors such as the "skew," "chain," "size abnormality," "overlap (multiple banknote transportation)," "ineligible denomination," "abnormal (indefinite) determination on denomination." FIG. 21 illustrates example factors in recognition. Other factors may be included. The "ineligible denomination" is the denomination which is out of the target of the banknote handling apparatus 1. The "abnormal (indefinite) determination on denomination" means that the denomination cannot be confirmed. (For example, although the banknotes are fed out of one of the storing modules 31 containing the banknotes of predetermined denomination, it cannot be confirmed that the banknotes are of the predetermined denomination.)

Each the plurality of factors in recognition by the recognition unit 25 can be set whether the factor is used for the determination (i.e., a factor in determination) on whether the banknotes are to be rejected or not to be rejected (i.e., whether or not the banknotes are the normal banknotes), or not used for the determination (i.e., a non-factor in determination). This setting may be performed by user's hand operation of the operation unit 55 of the banknote handling apparatus 1. The settings are stored in the memory unit 59. In setting, the display unit 511 of the banknote handling apparatus 1 may display a picture for setting. Alternatively, the setting may be performed by user's hand operation at the higher-ranking terminal T which is connected to the banknote handling apparatus 1 via the communication unit 57. The settings set in the higher-ranking terminal T are sent from the higher-ranking terminal T to the communication unit 57 as a signal for settings. The memory unit 59 stores the settings based on the signal received by the communication unit 57.

In the example of FIG. 21, in the depositing processing, all the factors in recognition of "skew," "chain," "size abnormality," "overlap (multiple banknote transportation)," "ineligible denomination," "abnormal (indefinite) determination on denomination" are set as the factors in determination. (In FIG. 21, "rejection" represents setting as a factor in determination.) That is, corresponding to any of the factors in recognition, the banknotes are determined as the banknotes to be rejected.

On the other hand, in the dispensing processing and in the reconciliation processing, not all the factors in recognition of "skew," "chain," "size abnormality," "overlap (multiple banknote transportation)," "ineligible denomination," "abnormal (indefinite) determination on denomination" are set as the factors in determination. Out of the factors in recognition, the "overlap" and "ineligible denomination" are set as the factors in determination, while the other factors, the "skew," "chain," "size abnormality," and "abnormal (indefinite) determination on denomination" are not the factors in determination (i.e., the non-factors). (In FIG. 21, "OK" represents setting as a non-factor.) Thus, in the dispensing processing and in the reconciliation processing, the banknotes corresponding to the "overlap" and "ineligible denomination" are determined as the banknotes to be rejected, while the banknotes corresponding to the "skew," "chain," "size abnormality," and "abnormal (indefinite) determination on denomination" are determined as the banknotes not to be rejected, i.e., the normal banknotes. As such, in the dispensing processing and in the reconciliation processing, part of the factors in recognition are the non-factors, thereby reducing the factors in determination so that a reduced number of the banknotes are determined as the banknotes to be rejected.

In this example, with respect to the factors in recognition, which may be the non-factors, the number of the banknotes can be specified. Specifically, at the occurrence of the "overlap," it is recognized that the thickness of the banknote detected when passing through the recognition unit 25 has a thickness of two or more banknote. However, the number of the banknotes cannot be specified. Thus, when the banknotes recognized as corresponding to the "overlap" in the dispensing processing are paid out to the outlet 231, the number of the banknotes paid out to the outlet 231 becomes indefinite. This leads to miscount. The banknotes recognized as corresponding to the "overlap" in the reconciliation processing need to be handled as the banknotes to be rejected. Otherwise, the inventory amount of the banknotes in the corresponding storing module 31 cannot be confirmed. Therefore, the factors in recognition not specifying the number of the banknotes cannot be set as the non-factors. Only the factors in recognition specifying the number of the banknotes are set to the non-factors.

In the example of FIG. 21, the "ineligible denomination" is also not set as the non-factor. This is because, since the denomination is not specified, the amount of dispensing cannot be specified when the banknotes are determined as the banknotes not to be rejected in the dispensing processing and are paid out to the outlet 231. This may lead to miscount. A similar problem may occur in the reconciliation processing.

In the example of FIG. 21, "abnormal (indefinite) determination on denomination" is the non-factor, and the recognition result in the depositing processing is replaced with the recognition result in the dispensing processing or in the reconciliation processing. As described above, although the banknotes corresponding to the "abnormal (indefinite) determination on denomination" are those fed out of one of the storing modules 31 containing predetermined denomination in the dispensing processing and in the reconciliation processing, the predetermined denomination cannot be confirmed. However, in the depositing processing, the recognition has been normally performed and the denomination, etc. has been specified. Therefore, the recognition in the depositing processing can be used without change. In the recognition unit 25, with respect to the banknotes recognized as corresponding to the "abnormal (indefinite) determination on denomination," the information on the banknotes stored in the memory unit 59 (i.e., the information which is stored based on the recognition in the depositing processing) is read. The information is then replaced with the recognition result in the dispensing processing or in the reconciliation processing. As a result, even when the banknotes, on which the denomination information etc. is not available in the dispensing processing, are paid out to the outlet 231 as the banknotes not to be rejected, the amount of dispensing can be confirmed, thereby increasing the reliability in the dispensing dealing. Similarly, the reliability in the reconciliation is provided.

In the example of FIG. 21, as a setting in the dispensing processing and in the reconciliation processing, the settings change depending on the above-described storage flags indicating the normality/abnormality of the storing modules 31. As described above, when a storage flag indicating the condition of the corresponding storing module 31 is "abnormal" at the occurrence of an error or retry, etc., all the factors in recognition are regarded as the factors in determination. This is because, when the storage flag indicates "abnormal," the number of the banknotes stored in the storing module 31 is indefinite, and the banknotes cannot be managed, and the assumption that the banknotes stored in the storing module 31 are basically the normal banknotes is no more effective. With respect to the banknotes fed out of the storing module 31 with the "abnormal" storage flag, all the factors in recognition are the factors in determination. As a result, whether or not the banknotes fed out of the storing module 31 are to be rejected is precisely determined, thereby securing the reliability in the dispensing dealing and the reliability in the reconciliation.

Similarly, when an "incomplete" flag is set for one of the storing modules 31, all the factors in recognition are regarded as the factors in determination. The reason follows. The storing module 31 with the "incomplete" flag stores the banknotes recognized as the banknotes to be rejected in the reconciliation processing. In order to increase the reliability in the dispensing dealing, in the dispensing processing with the "incomplete" flag, all the factors in recognition are preferably regarded as the factors in determination, thereby reliably specifying the banknotes to be rejected.

In this example, the storage flag and the "incomplete" flag are set for each storing module 31. In each dispensing processing (i.e., each dealing), whether the banknotes fed out of the storing module 31 with a "normal" flag are to be rejected or not to be rejected may be determined in accordance with the settings of the factors/non-factors in determination for the "normal" flag. With respect to only the banknotes fed out of the storing modules 31 with the "abnormal" flags and the storing modules 31 with the "incomplete" flags, whether the banknotes are to be rejected or not to be rejected may be determined in accordance with the settings for the "abnormal" flag and the "incomplete" flag. (All the factors are the factors in determination in the figure.) This is also applicable to the reconciliation processing.

Assume that retry occurs in one of the storing modules 31 with a "normal" flag in the middle of the dispensing processing and accordingly, an "abnormal" flag is set for the storing module 31. After the "abnormal" flag is set, whether the banknotes are to be rejected or the banknotes not to be rejected may be determined in accordance with the settings for the "abnormal" flag. (All the factors are the factors in determination in the figure.)

What is claimed is:

1. A banknote handling apparatus for recognizing and handling banknotes, the apparatus comprising:

a depositing unit configured to deposit the banknotes;

a dispensing unit configured to dispense the banknotes;

a plurality of banknote storing units configured to store the banknotes;

a transport unit configured to transport the banknotes;

a recognition unit provided at the transport unit, and configured to recognize the banknotes;

a control unit configured to control the handling of the banknotes; and a portion for an optional attachment to which an escrow unit temporarily storing the banknotes in a process of the handling is selectively attachable, wherein the control unit includes an option control unit performing control corresponding to an attached state of the escrow unit, and control corresponding to an unattached state.

2. The banknote handling apparatus of claim 1, wherein the option control unit has common firmware corresponding to both of the attached and unattached states of the escrow unit, and the firmware is switchable between a first mode of performing the control corresponding to the attached state of the escrow unit, and a second mode of performing the control corresponding to the unattached state of the escrow unit.

3. The banknote handling apparatus of claim 2, wherein when the escrow unit is attached, the control corresponding to the unattached state is performed by switching the firmware from the first mode to the second mode.

4. The banknote handling apparatus of claim 2, further comprising:

an option detection unit configured to detect attachment of the escrow unit based on presence or absence of electrical connection or communications of the escrow unit.

5. The banknote handling apparatus of claim 4, further comprising:

an error alarm unit configured to notify an error when the firmware is switched to the first mode although the attachment of the escrow unit is not detected by the option detection unit.

6. A banknote handling apparatus for recognizing and handling banknotes, the apparatus comprising:

a depositing unit configured to deposit the banknotes;

a dispensing unit configured to dispense the banknotes;

a plurality of banknote storing units configured to store the banknotes;

a transport unit configured to transport the banknotes;

a recognition unit provided at the transport unit, and configured to recognize the banknotes;

a control unit configured to control the handling of the banknotes; and a chamber for an optional attachment, wherein none of the plurality of banknote storing units are located in the chamber for the optional attachment, a cassette attachable to and detachable from the banknote handling apparatus with the banknotes stored, or an additional storing unit provided in addition to the banknote storing units, is selectively attachable to the chamber for the optional attachment, the chamber for the optional attachment is switchable among an attached state of the cassette, an attached state of the additional storing unit, and an unattached state of the cassette and the additional storing unit, and the control unit includes an option control unit performing control corresponding to the attached state of the cassette, the attached state of the additional storing unit, or the unattached state of the cassette and the additional storing unit.

7. The banknote handling apparatus of claim 6, wherein the option control unit has common firmware corresponding to the attached state of the cassette, the attached state of the additional storing unit, and the unattached state, and the firmware is switchable among a first mode of performing the control corresponding to the attached state of the cassette, a second mode of performing the control corresponding to the attached state of the additional storing unit, and a third mode of performing the control corresponding to the unattached state of the cassette and the additional storing unit.

8. The banknote handling apparatus of claim 7, wherein when the cassette or the additional storing unit is attached, the control corresponding to the unattached state is performed by switching the firmware to the third mode.

9. The banknote handling apparatus of claim 7, further comprising:

an option detection unit configured to detect attachment of the cassette or the additional storing unit based on presence or absence of electrical connection or communications of the cassette or the additional storing unit.

10. The banknote handling apparatus of claim 9, further comprising:

an error alarm unit configured to notify an error when the firmware is switched to the first mode or the second mode although the attachment of the cassette or the additional storing unit is not detected by the option detection unit.

11. The banknote handling apparatus of claim 6, wherein the cassette includes a first frame supporting the cassette, the additional storing unit includes a second frame supporting the additional storing unit, and the chamber for an optional attachment includes a frame fixing unit for attachment of the first frame and the second frame.

12. A banknote handling apparatus recognizing and handling banknotes, the apparatus comprising:

a depositing unit configured to deposit the banknotes;

a dispensing unit configured to dispense the banknotes;

a plurality of banknote storing units configured to store the banknotes;

a transport unit configured to transport the banknotes;

a recognition unit provided at the transport unit, and configured to recognize the banknotes;

a control unit configured to control the handling of the banknotes;

a portion for an optional attachment to which an escrow unit temporarily storing the banknotes in a process of the handling is selectively attachable; and a chamber for an optional attachment to which a cassette attachable to and detachable from the banknote handling apparatus with the banknotes stored, or an additional storing unit provided in addition to the banknote storing units is selectively attachable, wherein the control unit includes an option control unit performing control corresponding to an attached state of the escrow unit, control corresponding to an unattached state of the escrow unit, control corresponding to an attached state of the cassette or the additional storing unit, and control corresponding to an unattached state of the cassette or the additional storing unit.

13. The banknote handling apparatus of claim 12, wherein the option control unit has common firmware corresponding to both of the attached and unattached states of the escrow unit, and the attached state of the cassette, the attached state of the additional storing unit, and the unattached state, the firmware is switchable between a first mode of performing the control corresponding to the attached state of the escrow unit, and a second mode of performing the control corresponding to the unattached state of the escrow unit, and the firmware is switchable among a third mode of performing the control corresponding to the attached state of the cassette, a fourth mode of performing the control corresponding to the attached state of the additional storing unit, and a fifth mode of performing the control corresponding to the unattached state of the cassette and the additional storing unit.

* * * * *